US006505019B2

(12) United States Patent
Sato et al.

(10) Patent No.: US 6,505,019 B2
(45) Date of Patent: Jan. 7, 2003

(54) IMAGE FORMING APPARATUS HAVING PAPER DUST REMOVING MEANS

(75) Inventors: Shougo Sato, Nagoya (JP); Takeshi Fuwazaki, Nagoya (JP)

(73) Assignee: Brother Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/852,746

(22) Filed: May 11, 2001

(65) Prior Publication Data

US 2001/0031154 A1 Oct. 18, 2001

Related U.S. Application Data

(60) Continuation-in-part of application No. 09/817,170, filed on Mar. 27, 2001, and a continuation-in-part of application No. 09/824,054, filed on Apr. 3, 2001, which is a division of application No. 09/409,386, filed on Sep. 30, 1999, now Pat. No. 6,219,505.

(30) Foreign Application Priority Data

| | | |
|---|---|---|
| Sep. 30, 1998 | (JP) | 10-278033 |
| Sep. 30, 1998 | (JP) | 10-278034 |
| Jan. 12, 1999 | (JP) | 11-005276 |
| Jan. 18, 1999 | (JP) | 11-009266 |
| Feb. 8, 1999 | (JP) | 11-030531 |
| Mar. 16, 1999 | (JP) | 11-070020 |
| Mar. 27, 2000 | (JP) | 2000-086083 |

(51) Int. Cl.[7] ..... G03G 21/00
(52) U.S. Cl. ..... 399/98; 399/343
(58) Field of Search ..... 399/98, 149, 150, 399/343, 349, 127, 111

(56) References Cited

U.S. PATENT DOCUMENTS

| | | | | |
|---|---|---|---|---|
| 4,769,676 | A | 9/1988 | Mukai et al. | 399/150 |
| 5,436,700 | A | 7/1995 | Kikuchi et al. | 399/111 |
| 5,497,224 | A | 3/1996 | Ishikawa et al. | 399/354 |
| 5,587,774 | A | 12/1996 | Nagahara et al. | 399/176 |
| 5,610,697 | A | 3/1997 | Arai | 399/149 |
| 5,659,869 | A | 8/1997 | Ohtsuka et al. | 399/333 |
| 5,701,559 | A | 12/1997 | Ootaka et al. | 399/149 |
| 5,740,498 | A | 4/1998 | Tsuchiya | 399/98 |
| 5,774,768 | A | 6/1998 | Hazama et al. | 399/170 |

FOREIGN PATENT DOCUMENTS

| | | | |
|---|---|---|---|
| JP | 59-049575 | | 3/1984 |
| JP | U-62-181973 | | 11/1987 |
| JP | 01-161279 | | 6/1989 |
| JP | 01-295289 | | 11/1989 |
| JP | 04-089733 | * | 3/1992 |
| JP | 04-216569 | * | 8/1992 |
| JP | 05-150692 | * | 6/1993 |
| JP | 06-118842 | * | 4/1994 |
| JP | 06-130800 | * | 5/1994 |
| JP | 06-161169 | * | 6/1994 |
| JP | 06-332345 | * | 12/1994 |
| JP | B2-2619424 | | 3/1997 |

OTHER PUBLICATIONS

Hosoya, M. et al. "Cleanerless Laser Printing Using Monocomponent Nonmagnetic Development System," *Academic Presentations in Electronics Photography*, vol. 30, No. 3, 1991.

* cited by examiner

*Primary Examiner*—Sophia S. Chen
(74) *Attorney, Agent, or Firm*—Oliff & Berridge, PLC

(57) ABSTRACT

A first paper-dust removing device is provided to mainly remove pulp fibers of the paper dust. The first paper-dust removing device is located downstream from a transfer position in the photosensitive drum rotating direction. A second paper-dust removing device is provided to mainly remove talc in the paper dust. The second paper-dust removing device may be located downstream from the first paper dust removing device in the photosensitive drum rotating direction or upstream from the transfer position in the sheet conveying direction along the sheet transport path. An additional first paper-dust removing device may be located upstream from the transfer position in the sheet conveying direction along the sheet transport path.

12 Claims, 12 Drawing Sheets

IMAGE FORMING APPARATUS HAVING PAPER DUST REMOVING MEANS

CROSS-REFERENCE TO RELATED APPLICATION

This application is a continuation-in-part of U.S. application Ser. No. 09/817,170, filed Mar. 27, 2001 by Takeshi Fuwazaki, et al. and of application Ser. No. 09/824,054, filed Apr. 3, 2001 by Shougo Sato, et al., which is a division and claims the benefit of application Ser. No. 09/409,386, filed Sep. 30, 1999 now U.S. Pat. No. 6,219,505.

BACKGROUND OF THE INVENTION

1. Field of the Invention

The present invention relates to an image forming apparatus such as a laser printer.

2. Description of Related Art

Laser printers and other image forming apparatuses mainly include: a photosensitive drum, a developing roller, a transfer roller; and a sheet conveying mechanism. The photosensitive drum is formed with an electrostatic latent image on its outer peripheral surface. The developing roller is disposed in confrontation with the photosensitive drum. The developing roller supplies developing agent, such as toner, to the photosensitive drum, thereby developing the electrostatic latent image into a visible image. The transfer roller is disposed at a transfer position in confrontation with the photosensitive drum. The transfer roller is applied with a transfer bias voltage with a polarity opposite to that of the photosensitive drum. The sheet conveying mechanism conveys a sheet of paper along a sheet transport path in a paper conveying direction toward the transfer position. When the sheet of paper reaches the transfer position, the sheet of paper is brought into contact with the surface of the photosensitive drum.

Especially in non-contact type printers, a charger uniformly charges the outer peripheral surface of the photosensitive drum. A laser generating unit modulates a laser beam based on image data, and scans the laser beam across the outer peripheral surface of the photosensitive drum. As a result, a corresponding electrostatic latent image is formed on the surface of the photosensitive drum. The developing roller conveys, on its surface, toner that is electrically charged to the same polarity as that of the photosensitive drum. The electrostatic latent image on the photosensitive drum is developed into a visible toner image with the toner supplied from the developer roller according to a well-known reversal development process. The thus developed visible image is then transferred, at the transfer position, from the photosensitive drum onto a sheet of paper that reaches the transfer position. The visible image is pulled onto the sheet of paper by an electrostatic field that is generated by the transfer bias applied to the transfer roller. Thus, one image forming cycle is completed.

According to the above-described image forming cycle, some toner remains on the surface of the photosensitive drum after the toner image has been transferred from the photosensitive drum onto the sheet of paper. According to a well-known cleanerless method, this residual toner is collected during the next image forming cycle. Thus, in each image forming cycle, development and cleaning are performed simultaneously by the developing roller according to reversal development process.

According to this cleanerless method, there is no need to provide a blade or the type of cleaner device in the image forming apparatus. There is also no need to provide a vessel to accumulate waste toner. Accordingly, configuration of the entire image forming apparatus can be simplified and made more compact. The image forming apparatus can be produced less expensively.

It is noted that when the sheet of paper reaches the transfer position, the sheet of paper contacts the surface of the photosensitive drum, and paper dust clings to the surface of the photosensitive drum. This paper dust will be possibly collected together with the residual toner. When the toner is reused during a later development process, the paper dust can degrade the resultant visible image. When an acid type sheet is used as the sheet of paper, the paper dust includes filler material such as talc. The filler material can cause filming and so magnify the problem of the defective visible images.

There have been proposed several types of paper-dust removing device such as: (1) a rotational brush roller; (2) another rotational brush roller whose constituent brush fibers are formed in loops; and (3) a rotational non-woven fabric roller that includes a rubber roller covered with a non-woven fabric. The rotational brush roller (2) is disclosed in Japanese patent application publication (kokai) No.HEI-1-11667), and the rotational non-woven fabric roller (3) is disclosed in Japanese utility model application publication (kokai) No.SHO-62-181973.

However, these devices (1) through (3) have the following problems.

Devices (1) and (2) are able to properly remove fibers included in the paper dust. However, the brush in these devices is unable to sufficiently remove filler material such as talc in the paper dust from an acidic paper. As a result, talc will possibly be collected together with residual toner on the developing roller. The collected talc will generate an undesirable fogging phenomenon during subsequent development processes. That is, when an electrostatic latent image is developed with toner mixed with talc, fogging will be formed on the white areas of a developed image and as a result the image will be poor.

Device (3) is designed to strongly press the non-woven fabric against the photosensitive drum in order to properly remove both the fiber material and the filler material from the surface of the photosensitive drum. However, the non-woven fabric will scrape the paper dust across the surface of the photosensitive drum. As a result, the soft talc is spread across the surface of the photosensitive drum, resulting in filming of talc on the photosensitive drum surface. The performance of the photosensitive drum will deteriorate.

SUMMARY OF THE INVENTION

It is therefore an objective of the present invention to overcome the above-described problems and to provide an improved image forming apparatus that is capable of properly preventing paper dust from being collected together with the residual toner, thereby performing high quality image forming operation.

In order to attain the above and other objects, the present invention provides an image forming apparatus, comprising: a paper conveying unit conveying a sheet of paper along a predetermined paper transport path in a paper conveying direction toward a predetermined transfer position; an image transfer unit located on the transfer position, the image transfer unit transferring a visible image, which is formed by development agent, onto the sheet of paper transferred to the transfer position; a first paper dust removing member that is positioned at a first predetermined position upstream from the transfer position in the paper conveying direction along the paper transport path, the first paper dust removing member removing a first component in paper dust from the sheet of paper; and a second paper dust removing member that is positioned at a second predetermined position upstream from the transfer position in the paper conveying direction along the paper transport path, the second paper dust removing member removing a second component in paper dust from the sheet of paper.

The second paper dust removing member may remove also the first component from the sheet of paper, the second paper dust removing member having a greater ability of removing the second component than the first paper dust removing member.

The image transfer unit may include an image bearing body having an image bearing surface, the image bearing surface bearing thereon the visible image that is formed through development of an electrostatic latent image by the developing agent, the image bearing surface moving along a predetermined image moving path in a predetermined image moving direction, thereby carrying the visible image, the predetermined image moving path and the predetermined paper transport path being arranged so that the sheet of paper is brought into contact with the image bearing surface when the sheet of paper reaches the predetermined transfer position, the visible image being transferred from the image bearing surface to the sheet of paper when the sheet of paper reaches the predetermined transfer position. The image forming apparatus may further comprise a developing unit developing, with the developing agent, the electrostatic latent image into the visible image, the developing unit being located at a position downstream from the transfer position along the image moving path in the image moving direction.

The first component may include fiber material of the paper dust, and the second component may include filler material of the paper dust.

According to another aspect, the present invention provides an image forming apparatus, comprising: a paper conveying unit conveying a sheet of paper along a predetermined paper transport path in a paper conveying direction toward a predetermined transfer position; an image transfer unit located on the transfer position, the image transfer unit transferring a visible image, which is formed by development agent, onto the sheet of paper transferred to the transfer position; a first paper dust removing member that is positioned at a first predetermined position upstream from the transfer position in the paper conveying direction along the paper transport path, the first paper dust removing member removing a first component in paper dust from the sheet of paper; and a second paper dust removing member that is positioned at a second predetermined position upstream from the transfer position in the paper conveying direction along the paper transport path, the second paper dust removing member removing the first component and a second component in the paper dust from the sheet of paper, the second paper dust removing member having a greater ability of removing the second component than the first paper dust removing member.

According to another aspect, the present invention provides an image forming apparatus, comprising: a paper conveying unit conveying a sheet of paper along a predetermined paper transport path in a paper conveying direction toward a predetermined transfer position; an image bearing body having an image bearing surface, the image bearing surface bearing thereon a visible image that is formed through development of an electrostatic latent image by developing agent, the image bearing surface moving along a predetermined image moving path in a predetermined image moving direction, thereby carrying the visible image, the predetermined image moving path and the predetermined paper transport path being arranged so that the sheet of paper is brought into contact with the image bearing surface when the sheet of paper reaches the predetermined transfer position, the visible image being transferred from the image bearing surface to the sheet of paper when the sheet of paper reaches the predetermined transfer position; a first paper dust removing member that is positioned at a first predetermined position downstream from the predetermined transfer position in the image moving direction along the image moving path, the first paper dust removing member contacting the surface of the image bearing body to remove a first component in paper dust that clings to the surface of the image bearing body; and a second paper dust removing member that is positioned at a second predetermined position upstream from the transfer position in the paper conveying direction along the paper transport path, the second paper dust removing member removing a second component in paper dust from the sheet of paper.

According to still another aspect, the present invention provides an image forming apparatus, comprising: a paper conveying unit conveying a sheet of paper along a predetermined paper transport path in a paper conveying direction toward a predetermined transfer position; an image bearing body having an image bearing surface, the image bearing surface bearing thereon a visible image that is formed through development of an electrostatic latent image by developing agent, the image bearing surface moving along a predetermined image moving path in a predetermined image moving direction, thereby carrying the visible image, the predetermined image moving path and the predetermined paper transport path being arranged so that the sheet of paper is brought into contact with the image bearing surface when the sheet of paper reaches the predetermined transfer position, the visible image being transferred from the image bearing surface to the sheet of paper when the sheet of paper reaches the predetermined transfer position; and at least two paper dust removing members for removing at least two components of paper dust, respectively, at least one of the at least two paper dust removing members being positioned at a position upstream from the transfer position in the paper conveying direction along the paper transport path to remove a corresponding component in paper dust from the sheet of paper that is being conveyed at the position, thereby preventing the corresponding component of paper dust from being transferred to the image bearing body at the transfer position.

BRIEF DESCRIPTION OF THE DRAWINGS

The above and other objects, features and advantages of the invention will become more apparent from reading the following description of the embodiment taken in connection with the accompanying drawings in which:

FIG. 4(*b*) is a cross-sectional view illustrating the state how the second paper-dust removing device of a further modification and the first paper-dust removing device are provided;

FIG. 4(*c*) is a cross-sectional view illustrating the state how the second paper-dust removing device of still another modification and the first paper-dust removing device are provided;

FIG. 4(*d*) is a cross-sectional view illustrating the state how the second paper-dust removing device of a further modification and the first paper-dust removing device are provided;

FIG. 4(*e*) is a cross-sectional view illustrating the state how the second paper-dust removing device of another modification and the first paper-dust removing device are provided;

DETAILED DESCRIPTION OF THE EMBODIMENTS

Figure 1:
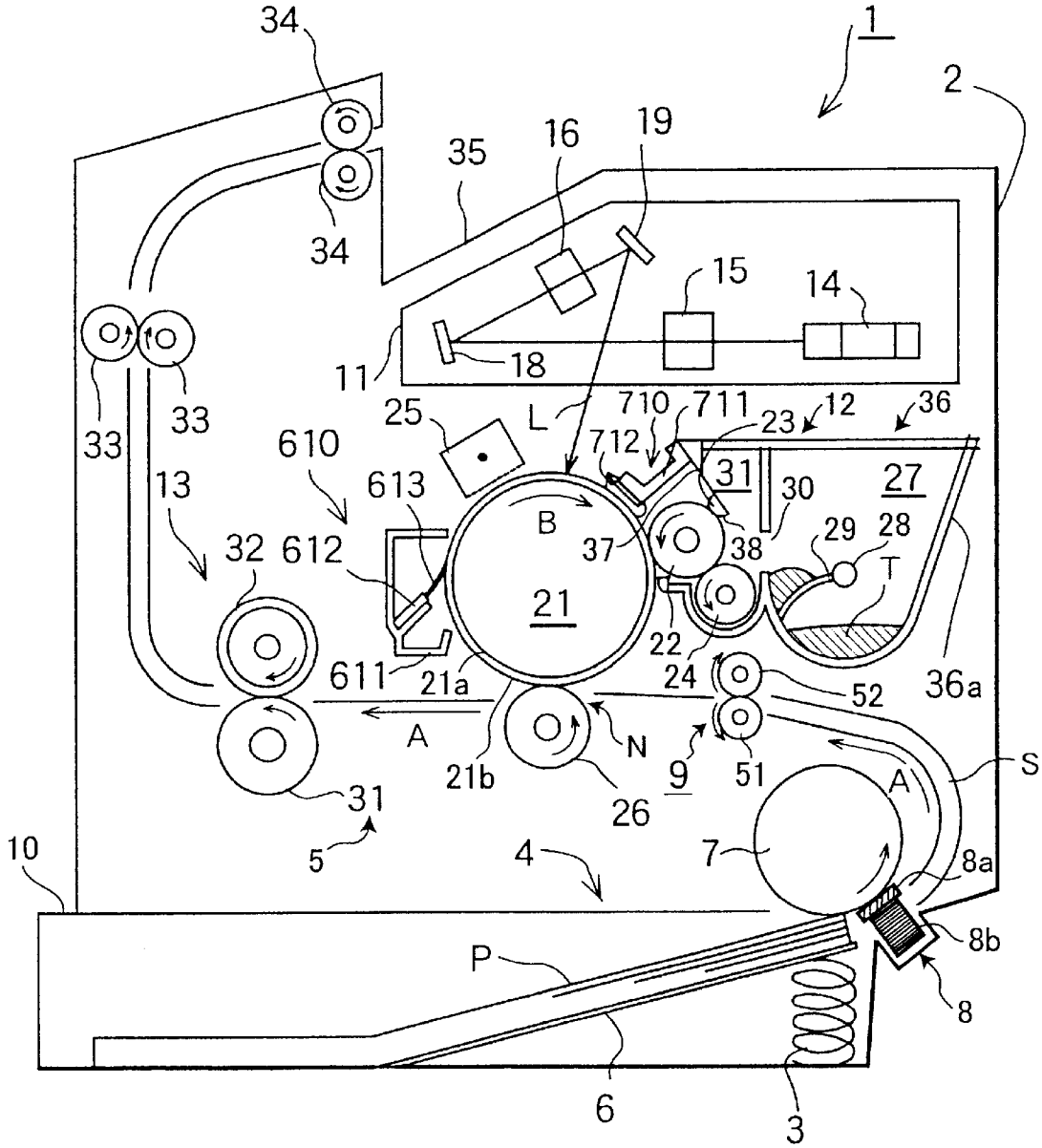
FIG. 1 is a cross-sectional view of an image forming apparatus according to a first embodiment.

An image forming apparatus according to preferred embodiments of the present invention will be described while referring to the accompanying drawings wherein like parts and components are designated by the same reference numerals to avoid duplicating description.

First Embodiment

An image forming apparatus according to a first embodiment of the present invention will be described below with reference to FIGS. 1–7.

FIG. 1 is a cross-sectional view showing essential parts of a laser printer 1 that serves as the image forming apparatus according to the first embodiment. As shown in FIG. 1, the laser printer 1 includes a housing or casing 2, in which a sheet feeding unit 4 and an image printing unit 5 are mounted. The sheet feed unit 4 is for supplying sheets of paper P to the image printing unit 5. The sheets of paper P serve as recording media to be printed with visible toner images. The image printing unit 5 is for printing visible toner images onto the sheets of paper P.

As shown in FIG. 1, the sheet feeding unit 4 is disposed at a bottom portion of the housing 2. The sheet feeding unit 4 includes: a sheet supply tray 10, a sheet separation member 8, a sheet supply roller 7, and a register roller unit 9. The sheet supply tray 10 is mounted detachably to the casing 2. The sheet supply tray 10 has a predetermined size and can hold those papers whose sizes are smaller than or equal to a predetermined maximum paper size.

The sheet supply roller 7 and the sheet separation member 8 are located within the casing 2 above one end of the sheet supply tray 10 when the sheet supply tray 10 is properly mounted within the casing 2. The register roller unit 9 is provided downstream from the sheet supply roller 7 with respect to a predetermined sheet transport direction A.

A sheet pressing plate 6 is provided within the sheet supply tray 10. Sheets of paper P can be stacked on the sheet pressing plate 6. The sheet pressing plate 6 is pivotably supported within the sheet supply tray 10 at its one end furthest from the sheet supply roller 7. Accordingly, the other end of the sheet pressing plate 6 nearest the sheet supply roller 7 is made movable in the vertical direction. A spring 3 is provided for urging the sheet pressing plate 6 upward from its under surface. With this arrangement, when the number of sheets stacked on the sheet pressing plate 6 increases, the sheet pressing plate 6 will pivot downwardly against the urging force of the spring 3 around its one end furthest from the sheet supply roller 7. One sheet at the upper most position on the stack on the sheet pressing plate 6 is pressed toward the sheet supply roller 7 by the spring 3 from the under side of the sheet pressing plate 6.

The sheet supply roller 7 and the sheet separation member 8 are disposed in confrontation with each other. The sheet separation member 8 includes a sheet supply pad 8*a* and a spring 8*b* provided to the rear side of the sheet supply pad 8*a*. The spring 8*b* presses the pad 8*a* towards the sheet supply roller 7. With this arrangement, when the sheet supply roller 7 rotates, the uppermost sheet is fed from the stack to a position between the sheet supply roller 7 and the sheet separation member 8. As the sheet supply roller 7 further rotates, the uppermost sheet P is fed toward the register roller unit 9.

The register roller unit 9 includes a drive roller (feed roller) 51 and a driven roller (pinch roller) 52. The sheet P fed out by the sheet feed roller 7 has its front edge aliened by the register roller unit 9 and then is transported to the image printing unit 5. In this way, one sheet at a time is fed out from the sheet feeding unit 4 and is transported along a predetermined sheet transport path S in a sheet transport direction A indicated by an arrow in the figure. Thus, a sheet of paper P is transported at a predetermined timing along the sheet transport path S.

As shown in FIG. 1, the image printing unit 5 includes a scanner unit 11, an image forming unit 12, and a fixing unit 13.

The scanner unit 11 is provided in the upper portion within the casing 2. The scanner unit 11 includes: a laser generator portion (not shown in the drawing); a polygon mirror 14, lenses 15 and 16; and reflection mirrors 18 and 19. The laser generating portion is for modulating a laser beam based on image data and for emitting the modulated laser beam. Laser light emitted from the laser generation portion reflects at the polygon mirror (five-sided mirror, for example) 14, passes through the lens 15, reflects at the reflection mirror 18, passes through the lens 16, and reflects at the reflection mirror 19 in this order. The laser beam is finally irradiated across the surface of a photosensitive drum 21 that is provided in the image forming unit 12 as will be described later.

As shown in FIG. 1, the image forming unit 12 is disposed below the scanner unit 11. The image forming unit 12 includes: a photosensitive drum 21, a Scorotron charger 25, a transfer roller 26; and a development cartridge (development unit) 36 that is detachably mounted to the casing 2. The development cartridge 36 has a toner box 27 and a development chamber 31. In the development chamber 31, a supply roller 24, a developing roller 22, and a layer-thickness regulating blade 23 are provided.

The toner box 27 is filled with toner T. According to this embodiment, this toner T is a nonmagnetic single component development agent. The toner T has electrically insulating properties, and is adapted for being electrically charged to a positive polarity. This positive polarity toner can develop electrostatic latent images on the photosensitive drum 21 when the photosensitive drum 21 is electrically charged to a positive polarity. Because the photosensitive drum 21 is charged to a positive polarity by the Scorotron charger, only an extremely small amount of ozone will be generated even when the Scorotron charger 25 is used in the non-contact condition. Additionally, the Scorotron charger can uniformly charge the photosensitive drum surface 21 with no irregularity. Accordingly, by using positive polarity toner, a uniform image development can be attained with only slight generation of ozone.

In this example, the toner T is a mixture of toner base particles with an external additive agent, such as silica, that is added to the outer surface of the toner base particles. The toner base particles have particle sizes in a range of between about 6 to 10 $\mu$m, with average particle diameter of about 8 $\mu$m. The external additive agent is added to the outer surface of the toner to improve fluidity of the toner.

The toner base particles are formed from a polymer that is produced by copolymerization of polymerizing monomers and that is mixed with coloring agent, wax, and charge control agent. The copolymerization process uses well known polymerization methods such as suspension polymerization. For example, the toner base particles can be formed by copolymerizing a styrene monomer, such as styrene, and an acryl monomer, such as acrylic acid, alkyl (C1~C4) acrylate, or alkyl (C1~C4) methacrylate. The thus polymerized toner base particles have a uniform particle diameter and therefore have a nearly spherical shape. The polymerized toner base particles have therefore extremely high fluidity and excellent charging ability. In this example, the toner base particles are formed from styrene acrylic resin that is formed by suspension polymerization into sphere shapes.

An example of the coloring agent mixed with the toner base particles includes carbon black.

Examples of the charge control agent include nigrosine, triphenylmethane, and quaternary ammonium salt.

The charge control agent is preferably made of charge control resin that is obtained by copolymerization of an two monomers, one of which is an ionic monomer. The ionic monomer has an ionic functional group such as ammonium salt. A representative example of the ionic monomer includes salt of N,N-diethyl-N-methyl-2-(methacrylo yloxy) ethyl ammonium and P-tolunenesulfonic acid. Examples of the monomer that is capable of copolymerizing with the ionic monomer include: styrene monomers such as styrene; and acrylic monomers such as acrylic acid, alkyl (C1~C4) acrylate, and alkyl (C1~C4) methacrylate.

When using such a charge control resin, by appropriately selecting the ratios of the respective monomers, the intermolecular distance between mutual ionic functional groups can be optionally selected. More specifically, if a compound of a single monomer that has an ionic functional group, such as quaternary ammonium, is used as the charge control agent, the resistance value of the resultant toner will possibly decrease with increase in the compound amount added to the toner material. This is because as the amount of the compound added to the toner material increases, the ionic functional groups in the compound will become positioned directly next to one another. This reduction in resistance can lead to reduction in the charging ability of the toner. Contrarily, according to the present embodiment, the charge control resin is composed not only from a single ionic monomer but also from another monomer. Accordingly, even when the amount of the charge control resin mixed to the toner material increases, the resistance value will not decrease. In other words, it is possible to prevent decrease of the resultant resistance value by changing the ratio of the amount of the functional groups relative to that of the material compolymerizing with the functional groups. Thus, it is possible to enhance charging ability of the toner. In particular, a stryene-acryl copolymer including quaternary ammonium salt that is obtained by copolymerization of the above-described monomers has excellent dispersion characteristic and charge stability characteristic.

In this example, the toner base particles are made from styrene/acryl copolymer that is obtained by copolymerization of styrene monomer and acrylic monomer and that is added with charge control resin formed from styrene-acryl copolymer including quaternary ammonium salt. Because the thus copolymerized toner material and charge control resin have the same styrene-acryl composition, the charge control resin can be more uniformly dispersed within the polymerized toner material, thereby enhancing charge ability of the toner material.

As shown in FIG. 1, a rotational shaft 28 is provided in the center of the toner box 27. An agitator 29 is supported on the rotational shaft 28. A toner supply port 30 is opened at a side wall of the toner box 27. The toner T in the toner box 27 is agitated by the agitator 29 and is discharged through the toner supply port 30 to the development chamber 31.

The development chamber 31 is provided in fluid communication with the toner box 27 via the toner supply opening 30. The toner supply roller 24 is mounted within the development chamber 31 at a location adjacent to the toner supply port 30. The toner supply roller 24 is mounted rotatable in a counterclockwise direction as indicated by an arrow in the figure. The developing roller 22 is mounted also within the development chamber 31. The developing roller 22 is disposed in confrontation with the supply roller 24. The developing roller 22 is rotatable also in the counterclockwise direction indicated by the arrow in the figure. The toner supply roller 24 and the development roller 22 are disposed in abutment contact with each other so that both of the rollers 24 and 22 are slightly compressed.

The supply roller 24 has a metallic roller shaft covered by a roller portion that is formed from a conductive foam material. The development roller 22 has a metallic roller shaft covered by a roller portion that is made from a conductive rubber material. The roller portion of the development roller 22 is constructed from a main roller body and a coat layer covering the outer surface of the main roller body. The main roller body is formed from urethane rubber or silicone rubber and is dispersed with carbon fine particles. The main roller body therefore has electric conductivity. The coat layer is formed from urethane rubber or silicone rubber dispersed with fluorine. Because fluorine tends to charge to a negative polarity, the coat layer can enhance to positively-changing nature of the toner while bearing the toner thereon. The developing roller 22 is applied with a transfer bias with a polarity opposite to that of the photosensitive drum 21. The developing roller 22 has an electric resistance, of an amount between about $10^4$ and $10^8$ Ω, from its shaft center to its outer surface.

The layer-thickness regulating blade 23 is disposed within the development chamber 31 at a location adjacent to the development roller 22. The layer-thickness regulating blade 23 includes a blade body 37. The blade body 37 is formed from a plate spring that is made of metal such as stainless steel (SUS). A pressing portion 38 is integrally formed with the blade body 37 at its free end. The pressing portion 38 has a semicircular shape in cross-section and is formed from electrically-insulating silicone rubber. The blade body 37 is supported, at its base end, on a side wall 36*a* of the development cartridge 36. The blade body 37 is supported on the side wall 36*a* at such a location that the pressing portion 38 will be pressed against the development roller 22 by the resilient force of the blade body 37.

With this structure, when toner T is discharged from the toner box 27 into the development chamber 31, the toner T is supplied to the development roller 22 by rotation of the toner supply roller 24. The toner is electrically charged to a positive polarity due to friction between the toner supply roller 24 and the development roller 22, while being supplied onto the development roller 22. In association with rotation of the development roller 22, the toner on the development roller 22 passes between the developing roller 22 and the pressing portion 38 of the layer-thickness regulating blade 23. The toner is even further charged by friction between the developing roller 22 and the pressing portion 38, while being regulated to a toner layer of a predetermined thickness on the developing roller 22.

The photosensitive drum 21 is rotatably mounted in the casing 2. A drive mechanism (not shown) is provided to drive the photosensitive drum 21 to rotate at a predetermined timing in a clockwise direction B indicated by an arrow in FIG. 1. The development cartridge 36 is detachably mounted to the casing 2 at a position that the photosensitive drum 21 becomes in confrontation with the development roller 22.

The photosensitive drum 21 is constructed from a sleeve (drum body) that is electrically grounded, and a photosensitive layer formed on the outer surface of the sleeve. The photosensitive layer is formed from a material that is electrically charged to a positive polarity. For example, the photosensitive layer is made from an organic photoconductor whose main composition is polycarbonate. In this example, the photosensitive drum 21 has a hollow cylindrical sleeve 21*a* made of aluminum. A photoconductive layer 21*b* is provided over the outer peripheral surface of the sleeve 21*a*. The photoconductive layer 21*b* is made of polycarbonate dispersed with photoconductive resin, and has a predetermined thickness of about 20 micrometers, for example. The sleeve 21*a* is electrically grounded and is rotatably mounted to the casing 2.

The Scorotron charger 25 is mounted in the casing 2 at a location that is above the photosensitive drum 21 and that is separated from the photosensitive drum 21 by a predetermined distance. The Scorotron charger 25 is a positively charging type. The Scorotron charger 25 includes a tungsten wire or other type charge wire, and generates corona discharge therefrom. The Scorotron charger 25 is configured so as to be capable of electrically charging the surface of the photosensitive drum 21 uniformly to a positive polarity.

After the Scorotron charger 25 uniformly charges the surface of the photosensitive drum 21 to a positive polarity, the scanner unit 11 exposes the surface of the photosensitive drum 21 with a laser beam that is modulated by image data. When the electrically-charged surface of the photosensitive drum 21 is exposed to the laser beam, the electric potential at exposed portions is reduced to an electric potential lower than at non-exposed portions and at the developer roller 22. Thus, an electrostatic latent image is formed on the surface of the photosensitive drum 21.

As the development roller 22 rotates, the positively charged toner borne on the development roller 22 is brought into contact with the surface of photosensitive drum 21. As a result, the toner is supplied only to those areas that have their electric potential reduced according to the electrostatic latent image. Thus, the toner is selectively supplied to the surface of the photosensitive drum 21 to develop the electrostatic latent image into a visible toner image. Reversal development is achieved in this manner.

The transfer roller 26 is mounted in the casing 2 at a position below the photosensitive drum 21 and in confrontation with the photosensitive drum 21. The transfer roller 26 is mounted rotatable in the counterclockwise direction indicated by the arrow in FIG. 2. The transfer roller 26 has a metallic roller shaft covered with a roller made of a resilient conductive foam material such as rubber material (silicone rubber or urethane rubber, for example). The transfer roller 26 is applied with a transfer bias that has a polarity opposite to that of the photosensitive drum 21. Accordingly, the positively-charged toner borne on the photosensitive drum 21 is electrostatically attracted in a direction toward the transfer roller 26.

A predetermined transfer position N is defined on the sheet transport path S where the photosensitive drum 21 abuts against the transfer roller 26. The transfer position N is disposed downstream from the register roller unit 9 along the sheet transport path S in the sheet transport direction A. When the sheet of paper P is transported by the register roller unit 9 and reaches the transfer position N, the sheet of paper P passes between the photosensitive drum 21 and the transfer roller 26. At this time, the paper is brought into contact with the surface of the photosensitive drum 21. Accordingly, the visible toner image borne on the photosensitive drum 21 is transferred from the photosensitive drum 21 to the sheet of paper P.

As shown in FIG. 1, the fixing unit 13 is disposed downstream from the developing unit 12 along the sheet transport path S in the sheet transport direction A. The fixing unit 13 includes a thermal roller 32 and a pressing roller 31 that is pressed against the thermal roller 32. The thermal roller 32 is a hollow roller formed of metal, and encloses therein a halogen lamp for heating the roller 32. The thermal roller 32 is for thermally fixing toner onto a sheet of paper P as the sheet of paper P passes between the pressing roller 32 and the thermal roller 32.

A pair of transport rollers 33 are provided downstream from the fixing unit 13 in the sheet transport direction A. The sheet of paper P is therefore transported by the transport rollers 33 to a pair of discharge rollers 34. When the sheet of paper P reaches the pair of discharge rollers 34, the sheet of paper P is discharged by the discharge rollers 34 onto a discharge tray 35 that is provided on the upper surface of the casing 2.

With the above-described structure, during one image forming procedure, the charge unit 25 uniformly charges the surface of the photosensitive drum 21 to a predetermined electric potential (which will be referred to as "original electric potential" hereinafter) of a positive polarity. When the laser scanner unit 11 irradiates the surface of the photosensitive drum 21 with laser light L that has been modulated according to image information, the electric potential of the photosensitive drum drops, at its laser beam-exposed region, from the original potential to an electric potential lower than that of the development roller 22. Thus, a corresponding electrostatic latent image is produced on the surface of the photosensitive drum 21. The electrostatic latent image is made from an image area corresponding to the laser-exposed region having the reduced electric potential. A non-image area corresponds to an unexposed region that maintains the original electric potential. The positively-charged toner supported on the development roller 22 is electrostatically attracted toward the electrostatic latent image area having the reduced electric potential. Thus, the electrostatic latent image is developed into a visible toner image.

Rotation of the photosensitive drum 21 conveys the visible toner image formed thereon in the rotating direction B to the transfer position N where the transfer roller 26 abuts against the photosensitive drum 21. At the transfer position N, the visible toner image is transferred onto a sheet of paper P that has been supplied from the sheet feeder unit 4. Because the polarity of the transfer bias applied to the transfer roller 26 is opposite to those of the photosensitive drum 21 and of the toner, the visible toner image is transferred from the photosensitive drum 21 to the sheet of paper P that is being conveyed between the photosensitive drum 21 and the transfer roller 26.

Next, the sheet of paper P is transported to the fixing unit 13 and is further transported while being sandwiched between the thermal toner image is pressed and heated on the sheet of paper P and fixed onto the sheet P. The sheet P is discharged onto the discharge tray 35 at the upper surface of the laser beam printer 1 by the transport rollers 33 and the discharge rollers 34. This completes one cycle of image forming process.

According to the predetermined cleanerless method, when some residual toner remains on the surface of the photosensitive drum 21 after the transfer process during the image forming cycle, the residual toner will be collected by the developing roller 22 during the next image forming cycle, and will be reused for subsequent developing processes.

More specifically, during each cycle of image forming process, some toner remains on the photosensitive drum 21 after the toner image has been transferred onto the sheet of paper P. At the next image forming cycle, rotation of the photosensitive drum 21 first brings the residual toner into confrontation with the charge unit 25. When the charge unit 25 uniformly charges the photosensitive drum 21 back to the original electric potential, the residual toner is also charged to the original electric potential. Then, the laser beam exposure unit 11 irradiates the photosensitive drum 21 with a laser beam that is modulated corresponding to image information. As a result, the electric potential at the exposed area drops from the original potential, while the electric potential at the non-exposed area maintains the original potential. Further rotation of the photosensitive drum 21 brings the residual toner into confrontation with the development roller 22. Toner on the development roller 22 is transferred onto the exposed area, and therefore a part of the residual toner and exists on the exposed area will be buried in the newly-supplied toner. A remaining part of the residual toner that is located on the non-exposed area of the photosensitive drum 21 are electrostatically attracted to the development roller 22. Thus, the development roller 22 develops the electrostatic latent image while simultaneously collecting the residual toner on the photosensitive drum 21. According to this cleanerless process, there is no need to provide a cleaner device for cleaning residual toner. There is not need to provide a separate vessel for accumulating waster toner. Configuration of the printer 1 can therefore be simplified and made compact. Also, cost for producing the printer 1 can be reduced.

It is noted that in the laser printer 1 having the above-described structure, the surface of the photosensitive drum 21 directly contacts the sheet of paper P at the transfer position N. Therefore, paper dust easily clings to the surface of the photosensitive drum 21. If the paper dust is allowed to remain on the surface of the photosensitive drum 21 together with the residual toner, the paper dust will possibly be collected by the developing roller 22 together with the residual toner. This can result in formation of defective images during the subsequent image forming cycles.

A detailed explanation will be given for how paper dust generated from the sheets of paper P causes poor images. The main component of paper is pulp fiber, which is cellulose extracted from coniferous or broadleaf trees. Paper further includes filler material that makes the paper opaque or white; a sizing agent to reduce absorption of ink by the paper to prevent ink from spreading excessively through the paper; and a fixing agent that enhances absorption of the sizing agent by pulp fiber. Especially, acidic paper usually contains talc or clay as a filler, resin size as the sizing agent, and aluminum sulfate as the fixing agent.

Of these materials, pulp fiber and talc filler are the materials that especially adversely affect the electrophotographic process. If the pulp fiber events the developing cartridge 36 that uses nonmagnetic single component toner T, the pulp fiber can be caught between the layer-thickness regulating blade 23 and the developing roller 22, and will damage the layer-thickness regulating blade 23 or the developing roller 22. Additionally, toner will possibly cling to the pulp fiber. The pulp fiber attached with the toner will possibly pass between the development roller 22 and the layer-thickness regulating blade 23 and then be transferred to the surface of a sheet of paper P. If this sheet of paper P passes through the fixing process and is discharged onto the discharge tray 35 with the pulp fiber attached thereon, the pulp fiber will appear as an undesirable black speck in white areas on the sheet of paper.

The talc has a storing tendency to be electrically charged to a negative polarity. Accordingly, when positive polarity toner is used, if talc mixes into the developing cartridge 36, then the charge amount of the toner will be reduced. This will cause fogging on resultant printed images. On the other hand, when negative polarity toner is used, then talc can result in fogging or even if fogging does not occur, the charged amount of toner might become too high so that the density of resultant images will drop.

Figure 2:
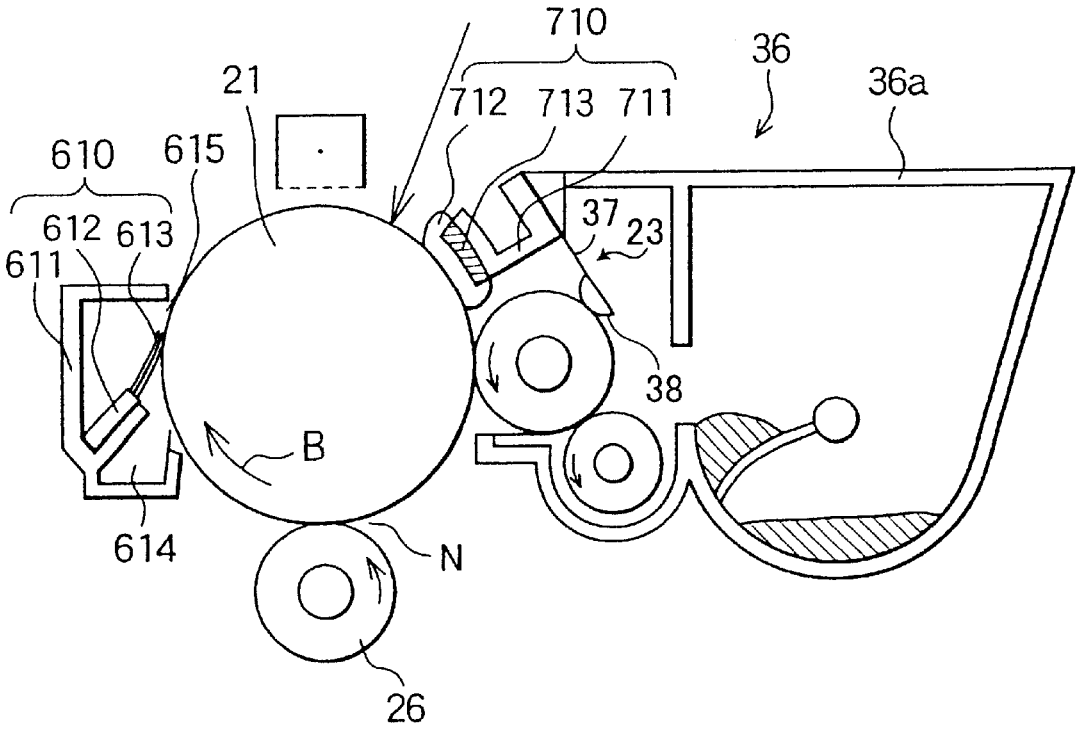
FIG. 2 is a cross-sectional view illustrating first and second paper-dust removing devices provided in the image forming apparatus of FIG. 1.

In order to solve this problem, according to the present embodiment, the laser printer 1 is provided with two paper-dust removing devices 610 and 710. The paper-dust removing devices 610 and 710 serve to remove paper dust that clings to the photosensitive drum 21. As shown in FIG. 2, the paper-dust removing devices 610 and 710 are disposed downstream from the transfer position N and upstream from the development roller 22 with respect to the rotational direction B of the photosensitive drum 21. The paper-dust removing devices 610 and 710 are located in contact with the surface of the photosensitive drum 21.

The first paper-dust removing device 610 is provided mainly for removing pulp fiber, while the second paper-dust removing device 710 is provided mainly for removing filler such as talc. The paper-dust removing device 610 is disposed downstream from the transfer position N in the rotational direction B of the photosensitive drum 21. The second paper-dust removing device 710 is disposed downstream from the first paper-dust removing device 610 in the rotational direction B of the photosensitive drum 21.

As shown in FIG. 2, the first paper-dust removing device 610 includes a casing 611, within which a support member 612 is fixedly mounted. An electrically insulating brush 613 is supported by the support member 612 to slantedly extend in the rotational direction B of the photosensitive drum 21 so that its front tip end contacts the surface of the photosensitive drum 21. The casing 611 includes a paper dust accumulation space 614 therein. The paper dust accumulation space 614 is located below the brush 613. The casing 611 also includes an opening 615 communicating with the paper dust accumulation space 614. The opening 615 is located at a predetermined position and has a predetermined size, thereby allowing paper dust, removed by the brush 613, to fall due to gravitational force and properly enter the space 614.

Having the above-described structure, the first paper-dust removing device 610 is disposed relative to the photosensitive drum 21 so that the brush 613 contacts the photosensitive drum 21 at a position that is directly downstream from the transfer position N in the rotational direction B of the photosensitive drum 21. At this position, paper dust including both pulp fiber and filler such as talc clings to the surface of the photosensitive drum 21. Because the brush 613 contacts the photosensitive drum 21 directly after the photosensitive drum 21 contacts a sheet of paper P at the transfer position N, the brush 613 can remove long and hard pulp fibers from the photosensitive drum 21. Rotation of the photosensitive drum 21 will convey residual components of the paper dust, such as filler material, downstream from the position where the brush 613 contacts the photosensitive drum 21 with respect to the rotational direction B of the photosensitive drum 21.

It is noted that the brush 613 has a width, in a direction orthogonal to the rotating direction B, which is longer than the width of the maximum sized paper that can be supplied from the sheet cassette 10. The width of the paper is defined along the direction orthogonal to the sheet conveying direction A when the sheet is conveyed along the sheet conveying path S.

The brush 613 is provided to contact the photosensitive drum 21 with an extremely small contact pressure. More specifically, the distance between the support member 612 and the photosensitive drum 21, the length of the brush 613, and the material of the brush 613 are selected so that the brush 613 can apply an extremely small contact pressure against the photosensitive drum 21. Accordingly, pulp fibers will not be accumulated where the brush 613 contacts the photosensitive drum 21, but instead will drop down by gravitational force into the space 614 of the casing 611 and be accumulated therein. Great amounts of pulp fiber will not accumulate where the brush 613 contacts the photosensitive drum 21. Accordingly, pulp fiber will not scratch the surface of the photosensitive drum 21, and filming is not generated by accumulation of talc.

As shown in FIG. 2, the second paper-dust removing device 710 includes a support member 711 that is integrally attached to the wall 36*a* of the developing cartridge 36. A non-woven fabric 712 lined by a back lining sponge 713 is supported on the support member 711. Because fibers are highly randomly entangled into an integral mass of the non-woven fabric 712, the non-woven fabric 712 can properly catch fine paper dust in between the fibers.

The fiber material of the non-woven fabric sheet 712 can include synthetic fiber, composite fiber, semi-synthetic fiber, reclaimed fiber, natural fiber, or other types of fiber. Representative examples of synthetic fiber include polyester fiber, polyamide fiber, polyolefine fiber, and acrylic fiber. Composite fiber includes a resin of the above-described synthetic fibers. An example of semi-synthetic fiber includes acetate fiber. Examples of reclaimed fiber include cupra and rayon. Examples of natural fiber include cotton, linen and wool. An example of other fiber-made products includes cotton blend.

It is noted that even a woven fabric or knitted fabric can be used instead of the non-woven fabric 712 because fibers entangled into the integral mass of the woven fabric or the knitted fabric can also catch the fine paper dust sufficiently.

It is also noted that the non-woven fabric 712 has a width, in a direction orthogonal to the rotating direction B, which is longer than the width of the maximum sized paper that can be supplied from the sheet cassette 10.

The non-woven fabric 712 is positioned so as to press against the photosensitive drum 21 with a pressing force of substantially a zero (0) value. That is, the support member 711 is separated from the photosensitive drum 21 by a distance equal to the total thickness of the non-woven fabric 712 and the back lining sponge 713. Because the non-woven fabric 712 is lined by the sponge 713, the pressing force against the photosensitive drum 21 is maintained at substantially zero for a long period of time.

Also, the non-woven fabric 712 contacts the photosensitive drum 21 at a position downstream in the rotational direction B of the photosensistive drum 21 than the position where the first paper-dust removing device 610 contacts the photosensitive drum 21. Because hard pulp fibers included in the paper dust have been removed by the first paper-dust removing device 610, hard pulp fibers will not accumulate where the nono-woven fabric 712 contacts the photosensitive drum 21. Accordingly, the surface of the photosensitive drum 21 will not be damaged by pulp fibers.

Because pressing force of the non-woven fabric 712 against the photosensitive drum 21 will be maintained at substantially zero pressing force and because the non-woven fabric 712 will not lose its soft character, filler material, such as relatively soft talc, caught by the non-woven fabric 712 will not be strongly pressed against the photosensitive drum 21. Accordingly, filming will not occur. In this way, the surface of the photosensitive drum 21 will not be damage, and talc can be reliably removed.

Because the non-woven fabric 712 is fixedly positioned to be pressed against the photosensitive drum 21, components of paper dust other than pulp fibers will likely accumulate between the non-woven fabric 712 and the photosensitive drum 21. However, the developing cartridge 36 is freely detachable from the laser printer 1, and therefore the second paper-dust removing device 710 can be exchanged with a new one when the developing cartridge 36 is exchanged with a new one. Accordingly, damage to the photosensitive drum 21, such as filming, that can possibly occur over long periods of time, can be properly prevented from occurring. More specifically, when deterioration of images is occurred due to decrease of the remaining amount of the developing agent in the developing cartridge 36, the developing cartridge 37 is removed from the laser printer 1. A new developing cartridge 36 is attached to the printer 1, thereby enabling formation of good images. When the developing cartridge 36 is thus replaced with a new one, the second paper dust removing device 710 attached to the developing cartridge 36 can be simultaneously replaced with a new one. Accordingly, even when paper dust accumulates on the contact portion between the second paper-dust removing device 710 and the photosensitive drum 21, damage of the photosensitive drum 21 and filming can be prevented.

Thus, according to the present embodiment, components of paper dust are investigated in detail and divided into fibers components, such as pulp fiber, and filler components, such as talc. The first paper-dust removing device 610 designed for removing fibers components is disposed upstream in the rotational direction B of the photosensitive drum 21 than the second paper-dust removing device 710 that is designed for removing filler components. Therefore, even when acidic paper is used as the recording medium, pulp fiber and talc can be reliably removed while filming by talc is not generated on the photosensitive drum 21. Thus, pulp fiber and talc can be prevented from entering the developing cartridge 36. Pulp fiber can be prevented from being transferred to the sheet of paper P. Defective images caused by fogging or stains on the recording sheet can be reliably prevented.

As described above, in the first removing device 610, the brush 613 is supported by the support member 612 that is attached to the interior of the causing 611. The device 610 mainly removes pulp fibers of the paper dust. The device 610 is located downstream from the transfer position N in the photosensitive drum rotating direction B. The second removing device 710 includes the support member 711 that is attached to the casing 36*a* of the developing cartridge 36. The support member 711 supports the non-woven fabric 712 that is lined by the sponge 713. The second removing device 710 mainly removes talc in the upper dust. The second removing device 710 is located downstream from the first removing device 610 in the photosensitive drum rotating direction B. In the device 710, the non-woven fabric 712 contacts the photosensitive drum 21 at substantially zero contact pressure.

Various modifications of the present embodiment will be discussed below.

Figure 3:
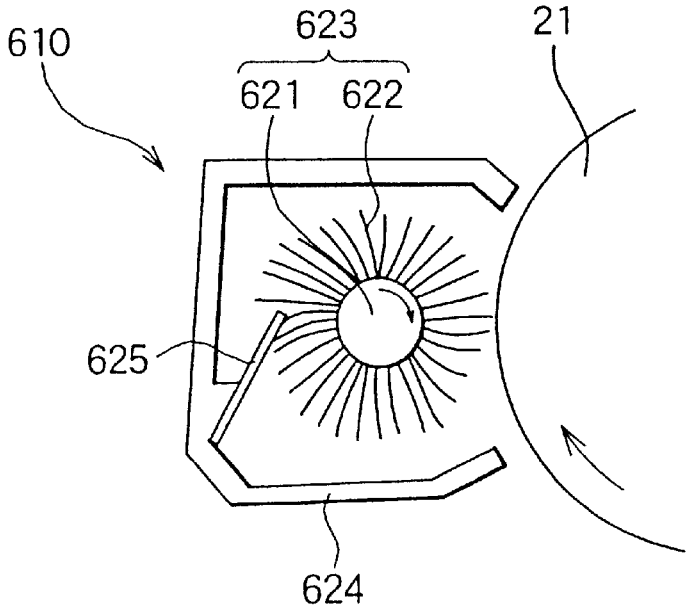
FIG. 3 is a cross-sectional view of a modification of the first paper-dust removing device of the first embodiment.
Figure 4A:
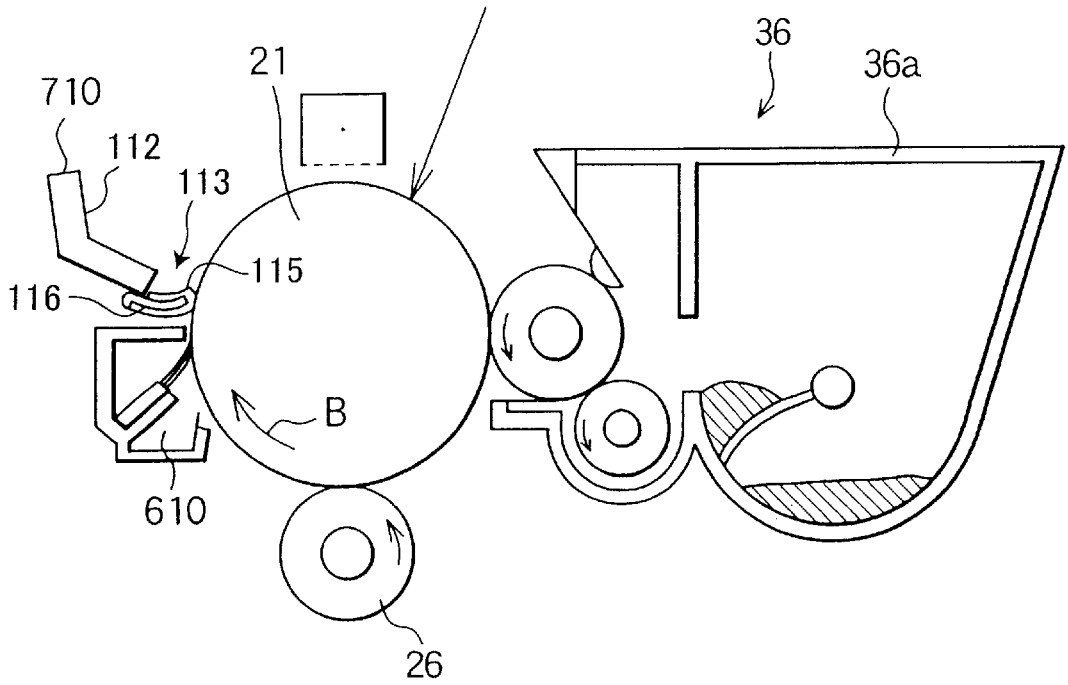
FIG. 4(*a*) is a cross-sectional view illustrating the state how the second paper-dust removing device of another modification and the first paper-dust removing device are provided.
Figure 4B:
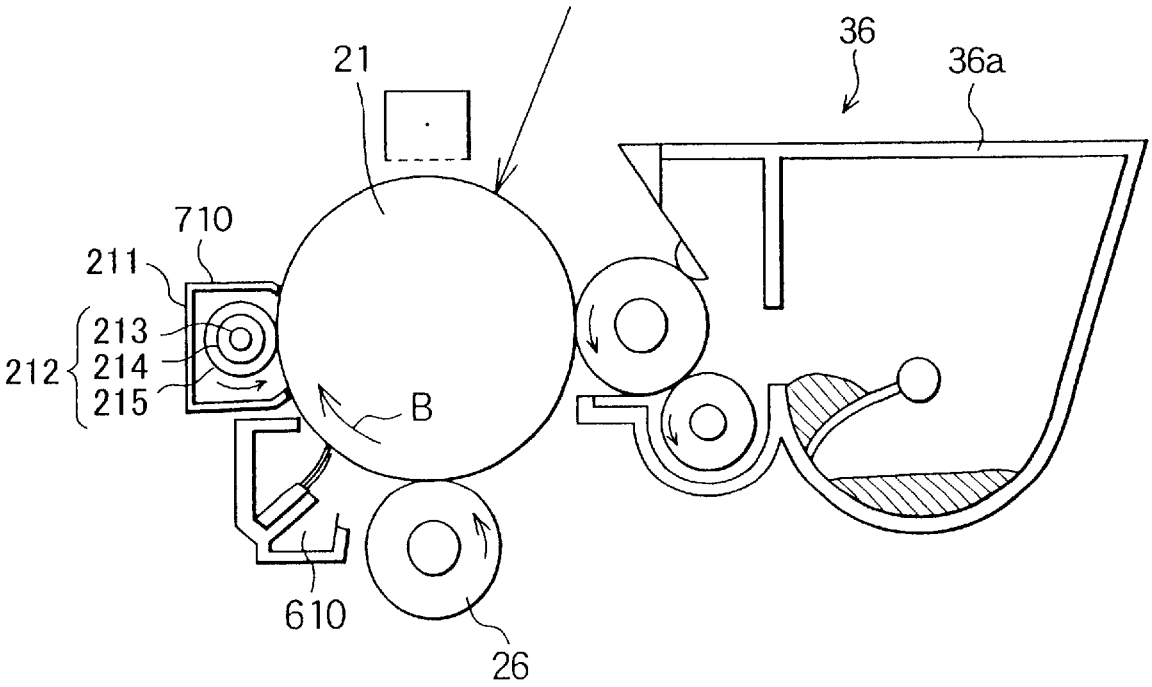
Figure 4C:
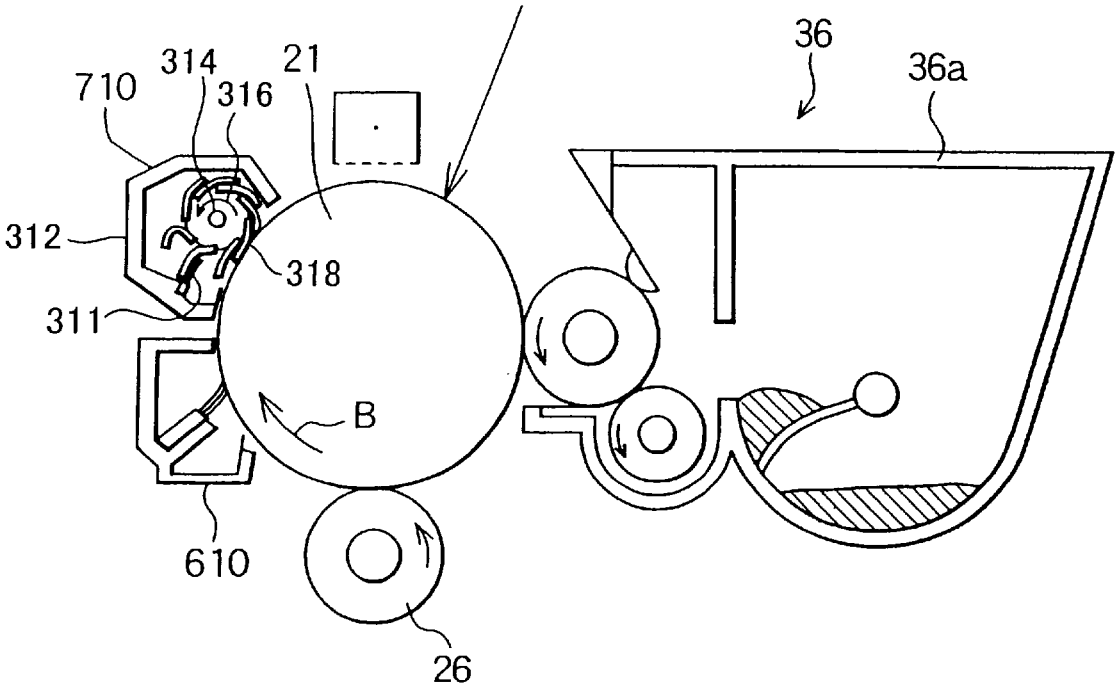
Figure 4D:
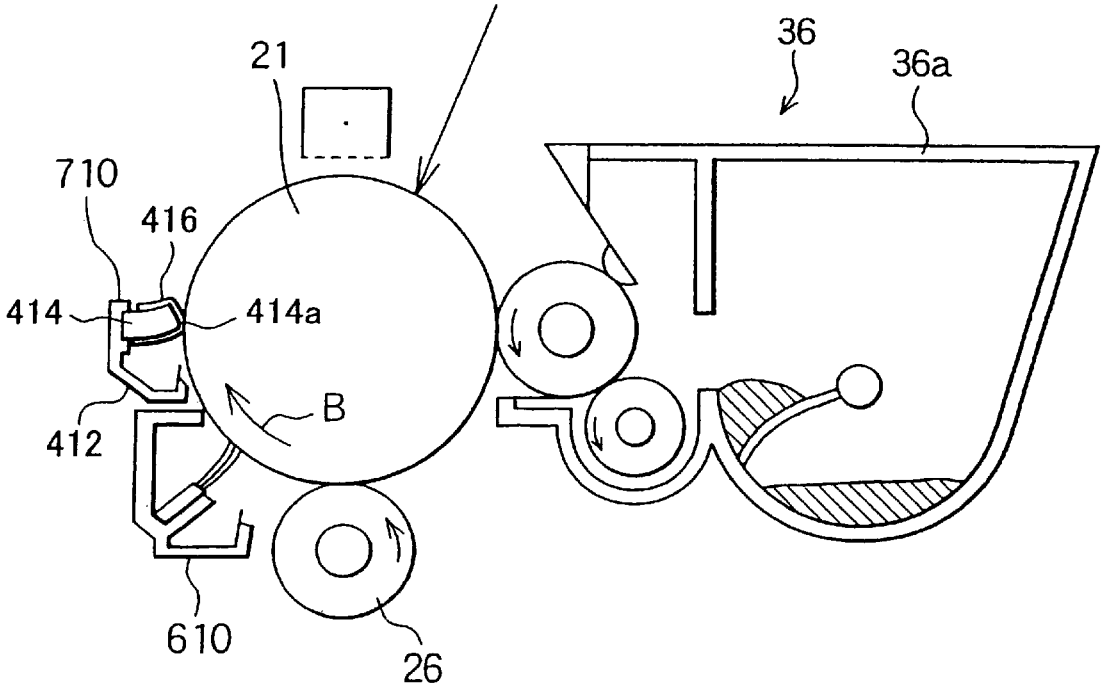
Figure 4E:
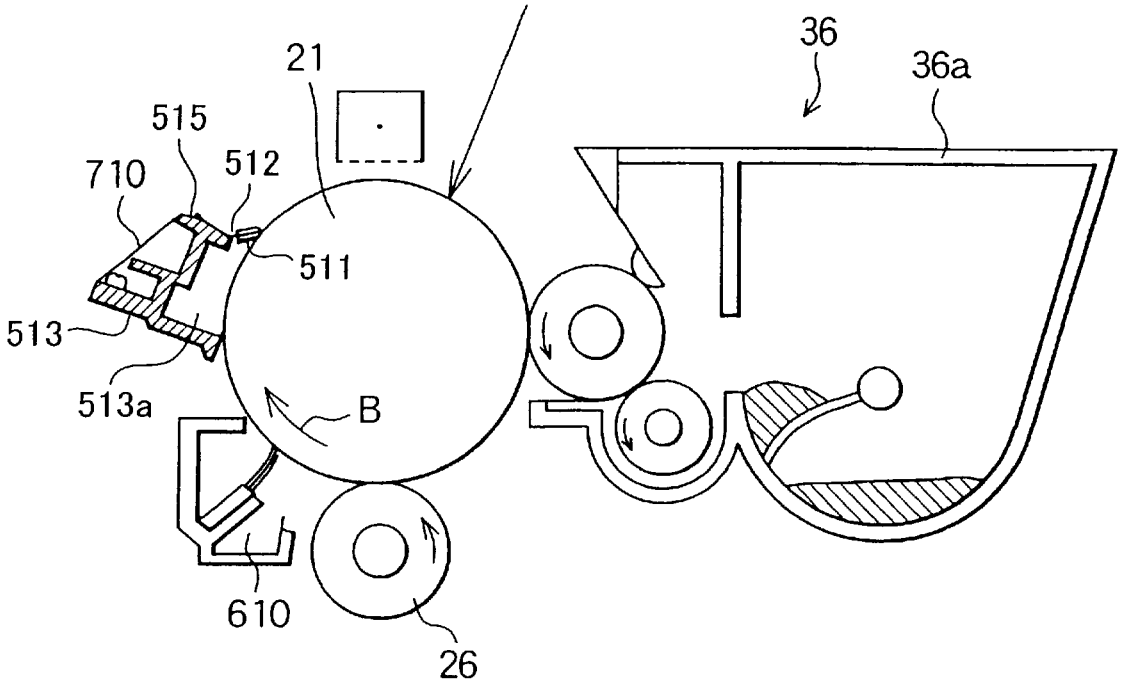

In the below description, the first paper-dust removing device 610 includes the electrically-insulating brush 613 that is fixedly secured to the casing 611. However, the first paper-dust removing device 610 can be configured as shown in FIG. 3. In this case, the first paper-dust removing device 610 includes a casing 624, within which a paper dust removing roller 623 is mounted. The paper dust removing roller 623 is mounted freely rotatably within the casing 624. A drive mechanism (not shown) is provided for driving the roller 623 to rotated in the same direction as the photosensitive drum 21.

The paper dust removing roller 623 is constructed from: a resilient roller 624 and an insulating brush 622 attached to the roller 621. Alternatively, the roller 621 may be made of a stiff material. The brush 622 is made of material that tends to charge to the same polarity as the material that tends to charge to the same polarity as the photosensitive drum 21 and that has the same charging characteristic as the photosensitive drum 21. Accordingly, the photosensitive drum 21 is not electrically charged even when the photosensitive drum 21 slidingly contacts the brush 622. For example, the insulating brush 622 is formed form nylon.

As shown in FIG. 3, a scraping member 625 is additionally mounted in the casing 624. The scraping member 625 is formed from a PET sheet and is positioned in contact with the brush 622.

The first paper-dust removing device 620 having the above-described structure is located at a position so that the brush 622 can be pressed against the photosensitive drum 21 with an extremely small pressing force. More specifically, the distance between the roller 621 and the photosensitive drum 21, the length of the brush 622 attached to the roller 621, and the material of the brush 622 are selected so that the brush 622 can apply an extremely small pressing force to the photosensitive drum 21. However, wiping force of the brush 622 can remove pulp fiber reliably from the surface of the photosensitive drum 21. Even when the pulp fiber removed by the brush 622 from the photosensitive drum 21 clings to the brush 622, the scraping member 625 scrapes the pulp fiber off the brush 622 so that the pulp fiber will not cling to the brush 622.

The roll-shaped brush 623 can properly remove fiber components of the paper dust. The contact portion of the roller 623 with the photosensitive drum 21 continuously changes according to rotation of the roll-shaped brush 623. The paper dust picking up efficiency is therefore enhanced. Paper fiber components are prevented from accumulating between the second paper-dust removing device 710 and the photosensitive drum 21.

Each of the brush 613 (FIG. 2) and the brush roller 623 (FIG. 3) of the first paper-dust removing device 610 can be configured to press against the photosensitive drum 21 with a contact force that can properly maintain a pattern of a residual toner image remaining on the surface of the photosensitive drum 21. The contact force is adjusted dependently on the nature of toner by changing the bending amount that the brush 613 or 622 bends in contact with the photosensitive drum 21. The bending amount can be changed by changing the length of the constituent fibers of the brush 613 or 622, the distance between the brush and the photosensitive drum 21, and/or the material of the brush-fibers.

Similarly, the non-woven fabric 712 of the second paper-dust removing device 710 can be configured to press against the photosensitive drum 21 with a contact force that can properly maintain the pattern of a residual toner image on the surface of the photosensitive drum 21. The contact force is adjusted dependently on the nature of toner by changing the material and thickness of the back lining sponge 713, and the distance between the support member 711 and the photosensitive drum 21. The back lining sponge 713 may be replaced with a thin PET film or the like.

The second paper-dust removing device 710 can be modified as shown in FIG. 4(*a*). In this modification, as shown in FIG. 4(*a*), the paper-dust removing device 710 includes: a base member 112 and a contact member 113 supported on the base member 112. One end of the base member 112 is fixed to the casing 2. One end of the contact member 113 is fixed to the other end of the base member 112. The contact member 113 is for contacting with the surface of the photosensitive drum 21. The contact member 113 is formed from: a back lining member 116 made from a urethane sheet, for example; and a non-woven fabric 115 lined by the back lining 116. One end of the lining member 116 is connected to the base member 112. With this structure, the pressure applied by the contact member 113 against the surface of the photosensitive drum 21 can be adjusted by appropriately selecting the material of the back lining member 116.

Alternatively, the second paper-dust removing device 710 of FIG. 2 can be modified by impregnating the non-woven fabric 712 with oil. For example, the non-woven cloth sheet 712 can be impregnated with at least one of mineral oil, synthetic oil, silicone oil, or a surfactant. Paraffin hydrocarbon, naphthene hydrocarbon, or aromatic hydrocarbon can be used as mineral oil. Alkylbenzene oil, polyolefine oil, or polyglycol oil can be used as synthetic oil. Chain dimethyl polysiloxane, cyclic dimethyl polysiloxane, methyl hydrogen polysiloxane, or a variety of different types of denatured silicone can be used as silicone oil. Either a cationic or nonionic surfactant can be used. A quaternary ammonium salt is preferably used as cationic type surfactant. Polyethylene glycol or a polyhydric alcohol can be used as the nonionic surfactant. One of a mixture of any of the above-described oil solutions are applied to the non-woven fabric sheet 712 to a ratio of 1% to 20% by weight of the non-woven cloth sheet 712. A proper cohesion force can be attained by those types of oil. The non-woven cloth sheet 712 can remove paper dust properly by the cohesion force.

The second paper-dust removing device 710 can be modified also as shown in FIG. 4(*b*).

In this modification, a paper dust remove roller 212 is rotatably mounted inside a casing 211. The paper dust remove roller 212 includes a non-woven fabric sheet 215 that is wrapped around a sponge roller 214. The sponge roller 214 is axially supported onto a shaft 213. The non-woven fabric sheet 215 is impregnated with oil agent. The paper dust removal roller 212 is configured to be driven to rotate by the rotation of the photosensitive drum 21. The roller 212 is positioned relative to the photosensitive drum 21 to as to contact the photosensitive drum 21 with a contact pressure of substantially zero (0). Even when the pressure applied by the paper dust removal roller 212 against the photosensitive drum 21 is approximately zero (0), paper dust such as talc and pulp fiber can be reliably removed by cohesion of the oil solution impregnated in the non-woven fabric sheet 215.

The paper-dust removing device 710 can be modified as shown in FIG. 4(*c*).

In this modification, a brush 311 is mounted in a casing 312. The brush 311 has an electric insulating property. A resin roller 316 is integrally formed with a roller shaft 314. Several non-woven fabric sheets 318 are attached to the surface of the resin roller 316. One end of each non-woven fabric sheet 318 is fixed to the resin roller 316 by adhesive, a two-sided adhesive tape, or the like. The sheet 318 is impregnated with oil agent. The roller 316 is located so that the non-woven fabric sheet 318 will hang down due to gravitational force to contact the photosensitive drum 21. The device 310 having the above-described structure is located so that the resin roller 316 is separated from the photosensitive drum 21 with the certain amount of gap and is positioned vertically above the position where the sheets 318 contact the photosensitive drum 21. Accordingly, the sheets 318 hang down due to their own weights to contact the photosensitive drum 21. The pressing force, with which the sheets 318 contact the photosensitive drum 21, can be properly reduced. The resin roller 316 can be driven to rotated. In this case, the free end of each non-woven fabric sheet 318 will contact the photosensitive drum 21 by gravitational or centrifugal force of the non-woven fabric sheet 318, thereby removing paper dust.

The second paper-dust removing device 710 can be modified as shown in FIG. 4(*d*).

In this modification, one end of the foam resilient member 414 is fixed to a case 412. The other end of the foam resilient member 414 protrudes toward the photosensitive drum 21. A non-woven fabric 416 is provided covering substantially the entire surface of the foam resilient body 414, and is adhesively attached thereto. The non-woven fabric 416 is impregnated with oil agent. When the photosensitive drum 21 rotates, the non-woven fabric 416 contact the photosensitive drum 21 at a corner 414*a* edge of the foam resilient body 414. The contact area, at which the non-woven fabric 416 contacts the photosensitive drum 21, can be made small. Accordingly, it takes a short period of time that the photosensitive drum 21 will contact paper dust causes by the contact member 416. Additionally, the pressing force, at which the non-woven fabric 416 contacts the photosensitive drum 21, can be made small. Accordingly, filming on the photosensitive drum 21 by the filler material can be prevented.

The second paper-dust removing device 710 can be modified as shown in FIG. 4(*e*).

In this modification, a non-woven fabric 511 is attached, with a two-sided adhesive tape, to the front tip end of a urethane sheet 512 that is made from urethane rubber. The urethane sheet 512 is adhered to the top surface 515 of a holder 513 with another two-sided adhesive tape. The top surface 515 of the holder 513 defines a chamber 513*a*. The non-woven fabric 511 abuts against the photosensitive drum 21, and therefore the urethane sheet 512 bends in the same direction as the direction B in which the photosensitive drum 21 rotates. Thus, the non-woven fabric 511 is pressed against the photosensitive drum 21 by resilient fore of the low harness urethane sheet 512. The non-woven fabric 511 can properly remove paper dust by catching the paper dust its constituent fibers even when only a low pressing force is used. Because the non-woven fabric 511 is impregnated with oil, paper dust including pulp fiber and talc can be reliably removed by cohesion force of oil.

The above description is directed to the laser beam printer 1 that transfers toner images directly from the photosensitive drum 21 to the sheets of paper P. However, the present embodiment can be applied to other types of image forming apparatus. For example, the present embodiment can be applied to a color copy machine 1000 of FIG. 5 that employs an intermediate transfer belt 1001 to transfer toner images from the photosensitive drum 21 to the sheets of paper P.

The image forming apparatus 1000 of this modification is a color copy machine for forming color images using four different color types of toner. The image forming apparatus 1000 includes the feeder unit 4, the photosensitive drum 21, the charge unit 25, the laser scanner unit 11, and the fixing unit 13 in the same manner as the image forming apparatus 1 of FIG. 1. However, the image forming apparatus 1000 includes four developing units 36Y, 36M, 36C, and 36Bk. The developing unit 36Y stores yellow toner, the developing unit 36M stores magenta toner, the developing unit 36C stores cyan toner, and the developing unit 36Bk stores black toner.

Although the laser beam printer 1 shown in FIG. 1 transfers the toner image from the photosensitive drum 21 directly to the sheet P, the copy machine 1000 of this modification employs the intermediate transfer belt 1001 for transferring a toner image of each color from the photosensitive drum 21 to the sheet of paper P. The intermediate transfer belt 1001 is made from electrically-chargeable polyimide. The intermediate transfer belt 1001 is applied with an electric voltage, while being pressed against the toner image on the photosensitive drum 21. The toner image is transferred from the photosensitive drum 21 to the intermediate transfer belt 1001 by electrostatic force. Afterward, the transfer roller 26 is applied with the toner image and whose value is higher than the voltage of the intermediate transfer belt 1001. Therefore, the toner is again transferred by an electrostatic force from the intermediate transfer belt 1001 to the sheet of paper P. In this way, according to the copy machine 1000, the photosensitive drum 31 does not directly contact the sheets of paper P, but the intermediate transfer belt 1001 directly contacts the sheets of paper P.

In order to remove paper dust from the intermediate transfer belt 1001, therefore, the first and second paper-dust removing device 610 and 710 are provided in contact with the intermediate transfer belt 1001. The paper dust on the intermediate transfer belt 1001 can be reliably removed so that formation of poor images can be prevented. Accordingly, it is possible to prevent transfer of paper dust from the intermediate transfer belt 1001 both to the photosensitive drum 21 and to sheets of paper P. It is possible to prevent occurrence of defective images.

For example, the first paper-dust removing device 610 having the configuration of FIG. 2 or 3 and the second paper-dust removing device 710 having the configuration of FIG. 2 or 4(*a*)–(*e*) can be mounted to remove paper dust clinging to the intermediate transfer belt 1001.

Figure 5:
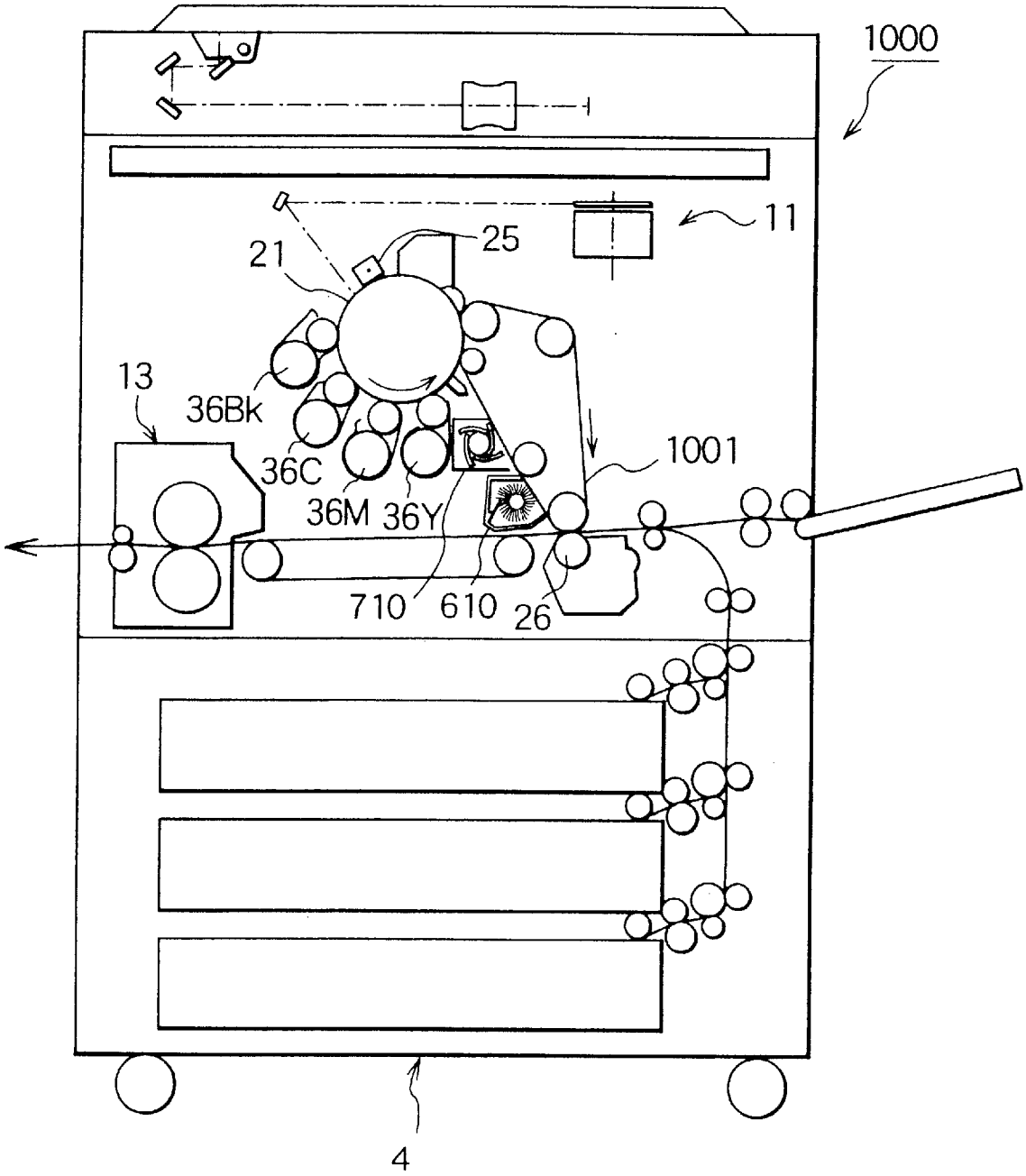
FIG. 5 is a cross-sectional view of an image forming apparatus of a modification according to the first embodiment.
Figure 6:
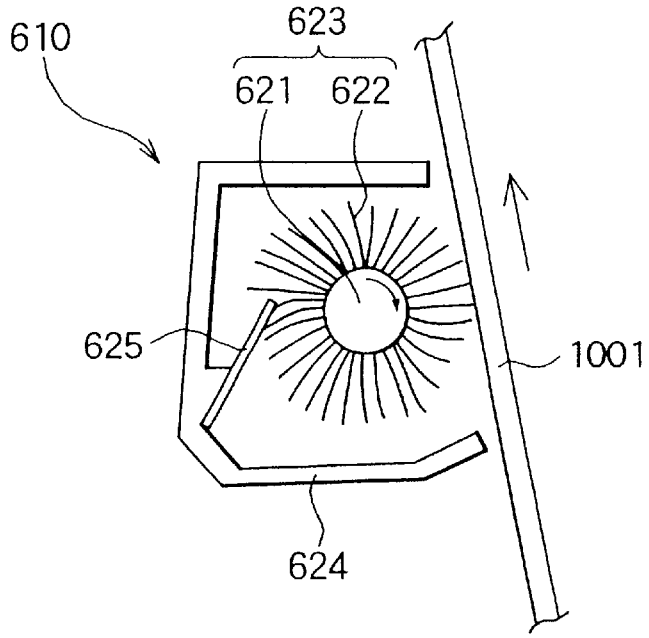
FIG. 6 is a cross-sectional view of the first paper-dust removing device employed in the image forming apparatus of FIG. 5.
Figure 7:
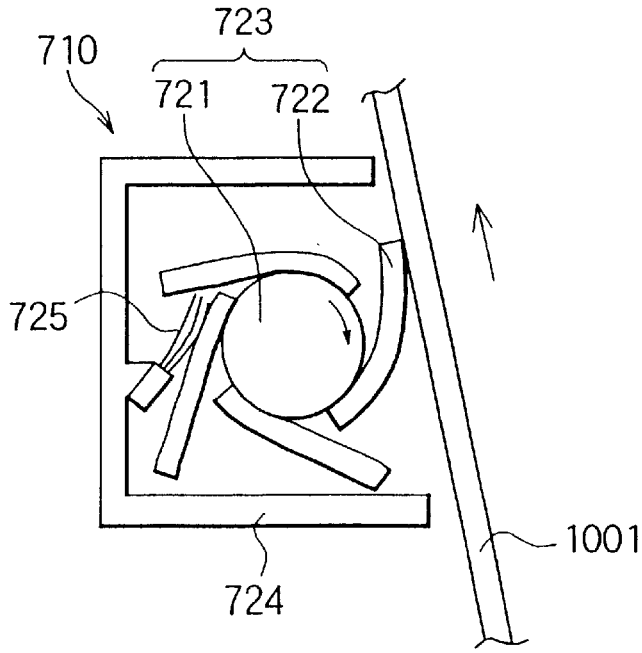
FIG. 7 is a cross-sectional view of the second paper-dust removing device employed in the image forming apparatus of FIG. 5.

In the example shown in FIG. 5, a first paper-dust removing device 610 having the configuration of FIG. 6 and a second paper-dust removing device 710 having the configuration of FIG. 7 are mounted in the copy machine 1000. The first paper-dust removing device 610 of FIG. 6 has the same configuration as that of FIG. 3.

As shown in FIG. 7, the second paper-dust removing device 710 includes a casing 724, within which a paper dust removing roller 723 is rotatably provided. The paper dust removing roller 723 is constructed from a resilient or stiff roller 721 which is attached with several strip-shaped non-woven fabric sheets 722. Each non-woven fabric sheet 722 is attached at one edge thereof to the roller 721 so that the free end of each non-woven fabric sheet 722 will overlap with the fixed end of an adjacent sheet 722.

A drive mechanism (not shown) is provided for driving the roller 723 to rotated in the same direction as the intermediate transfer belt 1001. Accordingly, each non-woven fabric sheet 722 moves in the opposite direction to the intermediate transfer belt 1001 at a position where the non-woven fabric sheet 722 contacts the intermediate transfer belt 1001.

A scraping brush member 725 is additionally provided in the casing 724 so as to be capable of contacting with each non-woven fabric sheet 722. When paper dust removed by one non-woven fabric sheet 722 from the intermediate transfer belt 1001 clings to the non-woven fabric sheet 722, the scraping member 725 scrapes off the paper dust from the non-woven fabric sheet 722.

Because the first paper-dust removing device 610 has reliably removed pulp fiber clinging to the intermediate transfer belt 1001 at an upstream position from the second paper-dust removing device 710, pulp fiber will not accumulate where each non-woven fabric sheet 722 contacts the intermediate transfer belt 1001. Accordingly, each non-woven fabric sheet 722 can be positioned so as to be pressed against the intermediate transfer belt 1001 with extremely light touch. Therefore, filming can be prevented from occurring. Also, the wiping force of the non-woven fabric sheets 722 can reliably remove talc from the intermediate transfer belt 1001. Accordingly, paper dust can be reliably removed from the intermediate transfer belt 1001.

Second Embodiment

A second embodiment will be described below with reference to FIGS. 8–13

According to the first embodiment, the image forming unit 12 is fixedly mounted in the casing 2. In other words, the photosensitive drum 21 and the charge unit 25 are mounted directly to the casing 2. The development cartridge 36 is detachably mounted to the casing 2.

Figure 8:
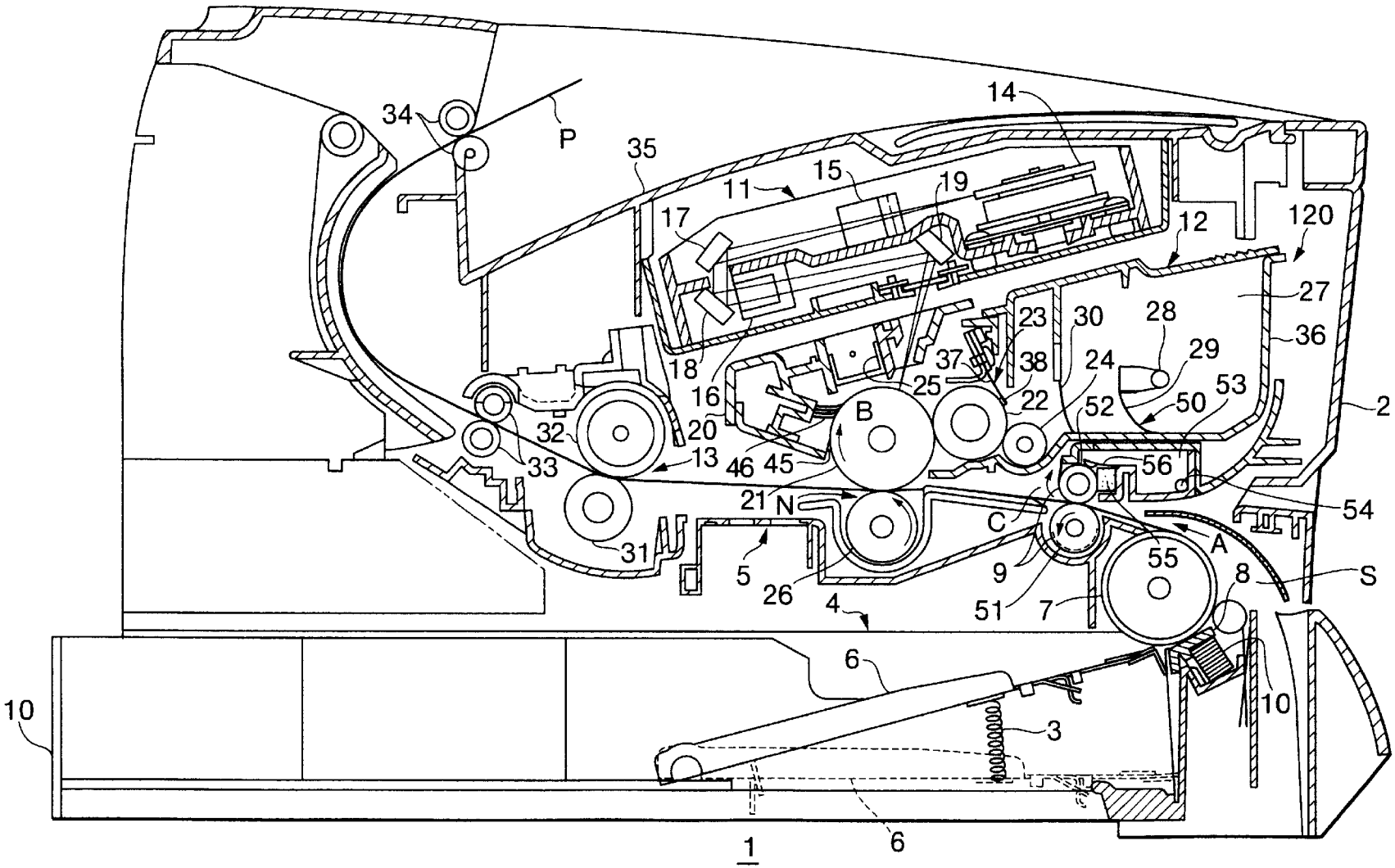
FIG. 8 is a cross-sectional view showing essential parts of a laser printer according to a second embodiment of the present invention.
Figure 9:
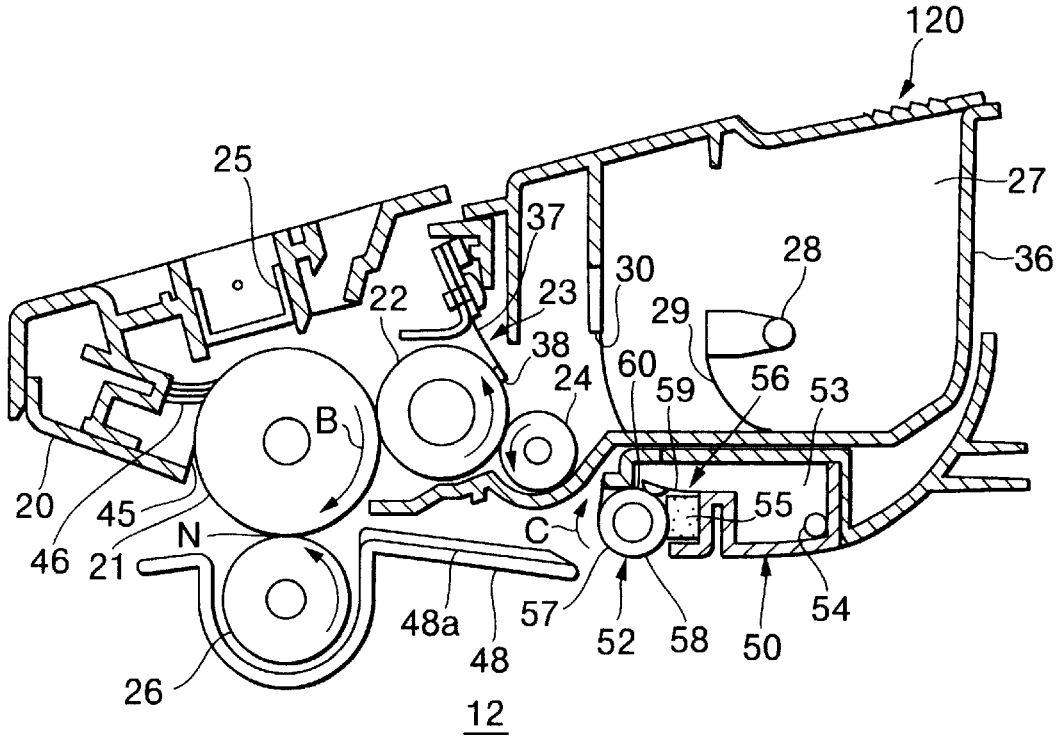
FIG. 9 is a cross-sectional view of a process cartridge mounted in the laser printer of FIG. 8.

Contrarily, according to the present embodiment, as shown in FIGS. 8 and 9, the image forming unit 12 is made from a process cartridge 120 that is detachably mounted to the casing 2.

The process cartridge 120 is constructed from a combination of a drum cartridge 20 and the development cartridge 36. In the drum cartridge 20, the photosensitive drum 21 and the Scorotron charger 25 are mounted. The photosensitive drum 21 is rotatably mounted in the drum cartridge 20. The drum cartridge 20 is detachably mounted to the side wall 36*a* of the development cartridge 36 so that the photosensitive drum 21 becomes in confrontation with the development roller 22. The entire process cartridge 120 is detachably mounted in the casing 2.

Similarly to the first embodiment, the transfer roller 26 is supported by the printer casing 2 so as to rotate counter-clockwise in FIG. 9. When the process cartridge 120 is mounted in the casing 2, the cylindrical surfaces of the transfer roller 26 and of the photoconductor drum 21 are in contact with each other at the transfer position N.

In the scanner unit 11, as shown in FIG. 8, an additional mirror 17 is provided to reflect the laser beam from the lens 15 in a direction toward the mirror 18.

As shown in FIG. 9, a lower film 45 is provided in the drum cartridge 20. The lower film 45 is for making uniform the potential of the cylindrical surface of the photoconductor drum 21 from which a visible image has been transferred to a sheet of paper P. The lower film 45 is supported in contact with the cylindrical surface of the photoconductor drum 21, and positioned downstream in the direction B of rotation of the drum 21 from the transfer position N, but upstream in the direction B from the Scorotron charger 25.

According to the present embodiment, a first paper dust removing brush 46 is provided for collecting pulp fibers in the paper dust that sticks to the cylindrical surface of the photoconductor drum 21 from which a visible image has been transferred. The first paper dust removing brush 46 is made from an electrically conductive material. The electrically conductive brush 46 is supported in contact with the cylindrical surface of the photoconductor drum 21, and positioned between the lower film 45 and the Scorotron charger 25.

It is noted that the brush 45 has a width, in a direction orthogonal to the rotating direction B, which is longer than the width of the maximum sized paper that can be supplied from the sheet cassette 10.

As shown in FIG. 8, similarly to the first embodiment, the register roller unit 9 is provided on the sheet transport path S, and serves as a sheet conveying mechanism for conveying the sheet of paper P in the sheet conveying direction A. According to the present embodiment, the pinch roller 52 in the register roller unit 9 is mounted to a second paper dust removing unit 50 of the present embodiment. The pinch roller 52 serves as a paper dust removing roller for removing filler material, such as talc, in the paper dust from the sheet of paper P that is being transported between the pinch roller 52 and the feed roller 51. Similarly to the first embodiment, the feed roller 51 is supported rotatably by the printer casing 2, and can be driven by the torque transmitted from the motor (not shown).

The second paper dust removing unit 50, including the pinch roller 52, is attached to the process cartridge 120.

More specifically, the second paper dust removing unit 50 is attached to the drum cartridge 20. The pinch roller 52 is supported rotatably in the second paper dust removing unit 50. When the process cartridge 120, attached with the second paper dust removing unit 50, is mounted in the printer casing 2, the cylindrical surfaces of the pinch roller 52 and of the feed roller 51 are in contact with each other. The register roller unit 9 can register the sheet of paper P fed from the feed roller 7, and feed the registered sheet in the sheet conveying direction A to the transfer portion N where the cylindrical surface of the photosensitive drum 21 contacts with that of the transfer roller 26.

As shown in FIG. 9, the second paper dust removing unit 50 is supported pivotally by the drum cartridge 20 at a location positioned at the bottom of the developing cartridge 36. The second paper dust removing unit 50 includes a paper dust retaining box 53 that serves as a paper dust reservoir. The paper dust retaining box 53 is elongated in a direction substantially parallel with the rotational axis of the cylindrical photosensitive drum 21, and has a rectangular cross-section as shown in FIG. 9. The paper dust retaining box 53 is supported pivotally by a pivot shaft 54, which is attached to the drum cartridge 20 of the process cartridge 120 and which extends substantially parallel with the rotational axis of the cylindrical photosensitive drum 21. The paper dust retaining box 53 has an opening at its top portion.

The pinch roller 52 is supported in the paper dust retaining box 53. The pinch roller 52 is supported rotatably on the free end of the dust retaining box 53. The bottom of the dust retaining box 53 has an opening, where part of the pinch roller 52 is exposed. When the process cartridge 120, thus attached with the paper dust retaining box 53, is mounted in the printer casing 2, the paper dust retaining box 53 pivots around the pivot shaft 54, thereby allowing the top opening to be positioned just under the flat bottom of the toner box 27. The pinch roller 52 moves together with the paper dust retaining box 53 around the pivot shaft 54 until the pinch roller 52 is properly positioned in contact with the feed roller 51 as shown in FIG. 8. Thus, the process cartridge 120, attached with the paper dust retaining box 53, is properly fitted in the printer casing 2. When the feed roller 51 drives to rotate in a counterclockwise direction (FIG. 8), the pinch roller 52 is driven to rotate in a clockwise direction C (FIG. 8). The feed roller 51 and the pinch roller 52 rotate together, and feeds the sheet of paper P, which is being sandwiched therebetween, in the sheet conveying direction A along the sheet transport path S. While thus conveying the sheet of paper P, the pinch roller 52 removes paper dust, such as filler material, from the sheet of paper P by contacting with the sheet of paper P.

As shown in FIG. 8, a sponge 55 is provided within the retaining box 53. The sponge 55 serves as a friction member and is in frictional contact with the cylindrical surface of the pinch roller 52. A scraper 56 is also provided in the retaining box 53. The scraper 56 is for scraping paper dust (filler material) off the pinch roller 52. The scraper 56 is supported in contact with the cylindrical surface of the pinch roller 52, and positioned upstream from the sponge 55 in the direction C of rotation of the pinch roller 52.

The pinch roller 52 includes a metallic shaft 57. The metallic shaft 57 is covered with a cylindrical member 58 made of electrically conductive rubber. The cylindrical surface of the cylindrical member 58 is coated with a layer of urethane rubber which contains fluorine or silicone rubber. The friction between this layer and the sponge 55 makes it possible to electrostatically charge the cylindrical surface of the pinch roller 52 more effectively. The roller shaft 57 is electrically grounded so that the cylindrical surface of the pinch roller 52 can be charged stably.

It is noted that the pinch roller 52 has a width, in a direction orthogonal to the sheet conveying direction A, that is longer than the width of the maximum sized paper that can be supplied from the sheet cassette 10.

The sponge 55 has a substantially rectangular cross-section as shown in the figure. The sponge 55 is positioned on one side of the pinch roller 52, which is away from the photosensitive drum 21. The sponge 55 is in frictional contact with the cylindrical surface of the pinch roller 52 so as to electrostatically charge this surface. Sponge is effective for electrically charging the pinch roller 52. It is preferable that the sponge 55 is made of urethane foam. urethane foam is much effective for electrically charging the pinch roller 52, and can improve the durability of the sponge 55.

The scraper 56 is in the form of a plate, and is positioned over the sponge 55 in such a manner that one end of the scraper 56 is in contact with the cylindrical surface of the pinch roller 52. The scraper 56 includes a polyethylene terephthalate film 59. A non-woven fabric 60 is fixed to one end of the film 59. The non-woven fabric 60 is in sliding contact with the surface of the pinch roller 52 so as to scrape paper dust (filler material) off the roller surface. Because such a soft member 60 can be positioned in close contact with the pinch roller 52, it is possible to effectively scrape the paper dust collected by this roller.

It is noted that the non-woven fabric member 60 has a width, in a direction orthogonal to the sheet conveying direction A, which is equal to or longer than that of the pinch roller 52. Accordingly, the width of the non-woven fabric member 60 is also longer than the width of the maximum sized paper that can be supplied from the sheet cassette 10.

Having the above-described structure, the second paper dust removing unit 50 operates as described below.

A sheet of paper P fed from the feed roller 7 is registered between the pinch roller 52 and the feed roller 51, and then fed to the transfer position N. While the sheet of paper P is being registered and fed, the pinch roller 52 in contact with the sheet P removes filler material, such as talc, from the sheet and the collects the filler material on its surface. As the pinch roller 52 rotates, the scraper 56 scrapes off the collected paper dust from the surface of the pinch roller 52. The scraped paper dust is retained in the retaining box 53. As the pinch roller 52 rotates in frictional contact with the sponge 55, the cylindrical surface of the pinch roller 52 is electrostatically charged sufficiently. The charged surface will contact with the sheet of paper P and will properly collect filler material from the sheet of paper. This series of operations is repeated. Because the cylindrical surface of the pinch roller 52 is charged in frictional contact with the sponge 55, this roller surface an catch filler material properly. The scraper 56 scrapes off the caught paper dust before the paper dust comes in contact with the sponge 55. The scraped paper dust can be retained effectively in the retaining box 53. This prevents the sponge 55 from being deteriorated by paper dust entering it. Consequently, it becomes possible to perform frictional charging operation properly for a long period of time.

Figure 10:
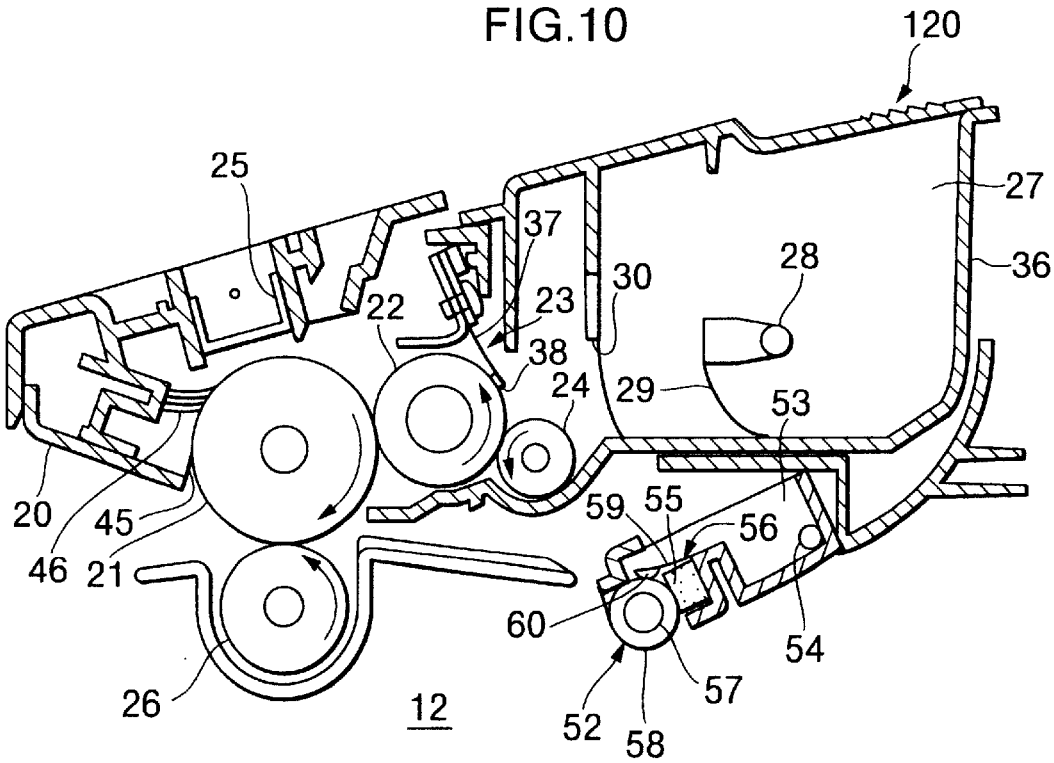
FIG. 10 is a cross-sectional view of the process cartridge removed from the printer casing.

As described already, the second paper dust removing unit 50 is supported pivotally at one end on the pivot shaft 54. Accordingly, when the process cartridge 120 is removed from the printer casing 2, as shown in FIG. 10, the other end (free end) of the second paper dust removing unit 50 moves down. However, the retaining box 53 has a protruding stopper (not shown), which engages with the process cartridge 120 to keep the second paper dust removing unit 50 from further pivoting counterclockwise in FIG. 10 when the retaining box 53 moves down by a predetermined angle with respect to the cartridge 120. Accordingly, it is possible to prevent the top opening of the remaining box 53 from facing vertically downwardly.

On the other hand, when the process cartridge 120 is properly mounted in the printer casing 2 as shown in FIG. 8, it is ensured that the pinch roller 52, which is supported by the retaining box 53, is positioned with its cylindrical surface in contact with the cylindrical surface of the feed roller 51, which is supported by the printer casing 2. This enables the rollers 51 and 52 to properly feed a sheet of paper P between them, and the pinch roller 52 to properly catch the paper dust from the sheet.

Figure 11:
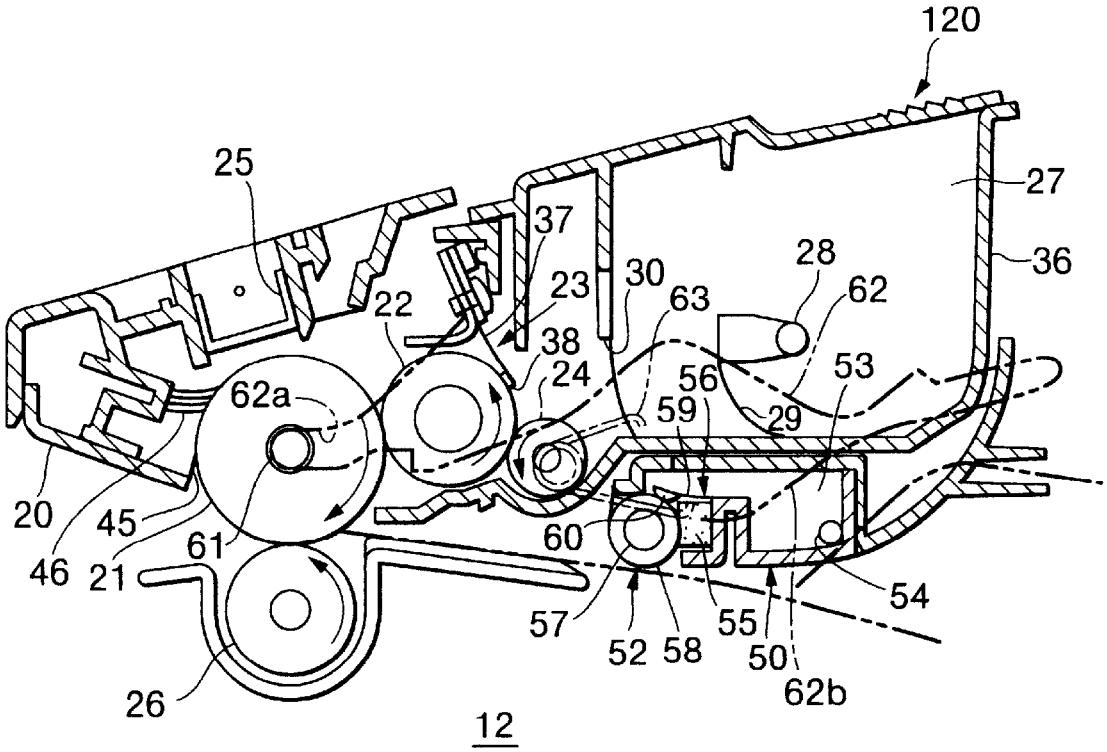
FIG. 11 is a cross-sectional view illustrating how the process cartridge is mounted in the printer casing.

As shown in FIG. 11, the process cartridge 120 includes a pair of guide protrusions 61. The guide protrusions 61 protrude coaxially with the photosensitive drum 21. The printer casing 2 has a pair of guide groove 62*a* (62) for guiding the protrusions 61 so that the cartridge 120 will be mounted in a correct position. The printer casing 2 has another pair of guide groove 62*b* (62) for guiding opposite ends of the roller shaft 57 of the pinch roller 52 so that the retainer box 53 will be mounted in a correct position.

When the process cartridge 120 is inserted into the printer casing 2, the guide protrusions 61 are guided by the guide grooves 62*a*, and both ends of the roller shaft 57 are guided by the guide grooves 62*b*. It is noted that as the both ends of the roller shaft 57 are guided by the guide grooves 62*b*, the free end of the retaining box 53 moves upwardly together with the pinch roller 52. When the guide protrusions 61 reach the closed ends of the guide grooves 62*a* and the ends of the roller shaft 57 reach the closed ends of the guide grooves 62*b*, it is ensured that the photosensitive drum 21 is positioned precisely with respect to the scanner unit 11 and the transfer roller 26 and that the pinch roller 52 is positioned with its cylindrical surface being in contact with the cylindrical surface of the feed roller 51.

As shown in FIG. 11, an urging spring 63 is provided in the printer casing 2. When the process cartridge 120 is mounted in the casing 2, the urging spring 63 is brought into engagement with the pinch roller 52. Accordingly, the spring 63 urges the pinch roller 52 downward against the feed roller 51. It is ensured that the pinch roller 52 is positioned properly relative to the feed roller 51 and can properly catch paper dust on the sheet of paper P.

The process cartridge 120 can be removed from the printer casing 2 by being simply pulled out of it. During the process cartridge 120 is being pulled out, the guide protrusions 61 are guided by the guide grooves 62*a*, and the shaft 57 of the pinch roller 52 is guided by the guide grooves 62*b*. Accordingly, the free end of the retaining box 53 moves downward as shown in FIG. 10.

When the process cartridge 120 is mounted in and removed from the casing 2, the sponge 55 moves together with the pinch roller 52. Accordingly, the relative positions of the sponge 55 and the pinch roller 52 are maintained. The sponge 55 can reliably perform stable frictional charging of the pinch roller 52.

Both of the second paper dust removing unit 50 and the first paper dust removing brush 46 are mounted to the printer process cartridge 120. Accordingly, when the process cartridge 120 is removed from the printer casing 2, it is possible to replace both of the second paper dust removing unit 50 and the first paper dust removing brush 46 with new ones. This facilitates the maintenance of the printer 2.

According to the present embodiment, the second paper dust removing unit 50 is provided at a position that is upstream from the transfer position N in the sheet conveying direction A along the sheet transport path S. The pinch roller 52 in the second paper dust removing unit 50 can remove filler material from the sheet of paper P that is being transported between the pinch roller 52 and the feed roller 51. The non-woven fabric member 60 can remove the filler material that is clinging to the surface of the pinch roller 52. After the second paper dust removing unit 50 removes filler material from the sheet of paper P, the sheet of paper P reaches the transfer position N where the sheet of paper P contacts the cylindrical surface of the photosensitive drum 21. At this time, only the remaining paper dust, that is, pulp fibers will cling the cylindrical surface of the photosensitive drum 21. As the photosensitive drum 21 rotates in the rotating direction B, the pulp fibers will be transported. When the pulp fibers reach the position where the first paper dust removing brush 46 contacts the cylindrical surface of the photosensitive drum 21, the first paper dust removing brush 46 will remove the pulp fibers from the cylindrical surface of the photosensitive drum 20. Because the first paper dust removing brush 46 is positioned upstream, in the rotating direction B, from the developing position where the developer roller 22 contacts the photosensitive drum 20. It is therefore possible to prevent any paper dust from entering into the developer cartridge 36.

It is noted that the second paper dust removing member 50 can remove also fiber material from the sheet of paper. Thus, the second paper dust removing member 50 can remove both of fiber material and filler material from the sheet of paper. That is, the non-woven fabric 60 can remove both of fiber material and filler material from the sheet of paper. Contrarily, the first paper dust removing brush 46 can hardly remove filler material from the cylindrical surface of the photosensitive drum 21. Thus, the ability of the second paper dust removing member 50 removing the filler material is greater than the ability of the first paper dust removing brush 46 removing the filler material.

A modification of the present embodiment will be described below.

Figure 12:
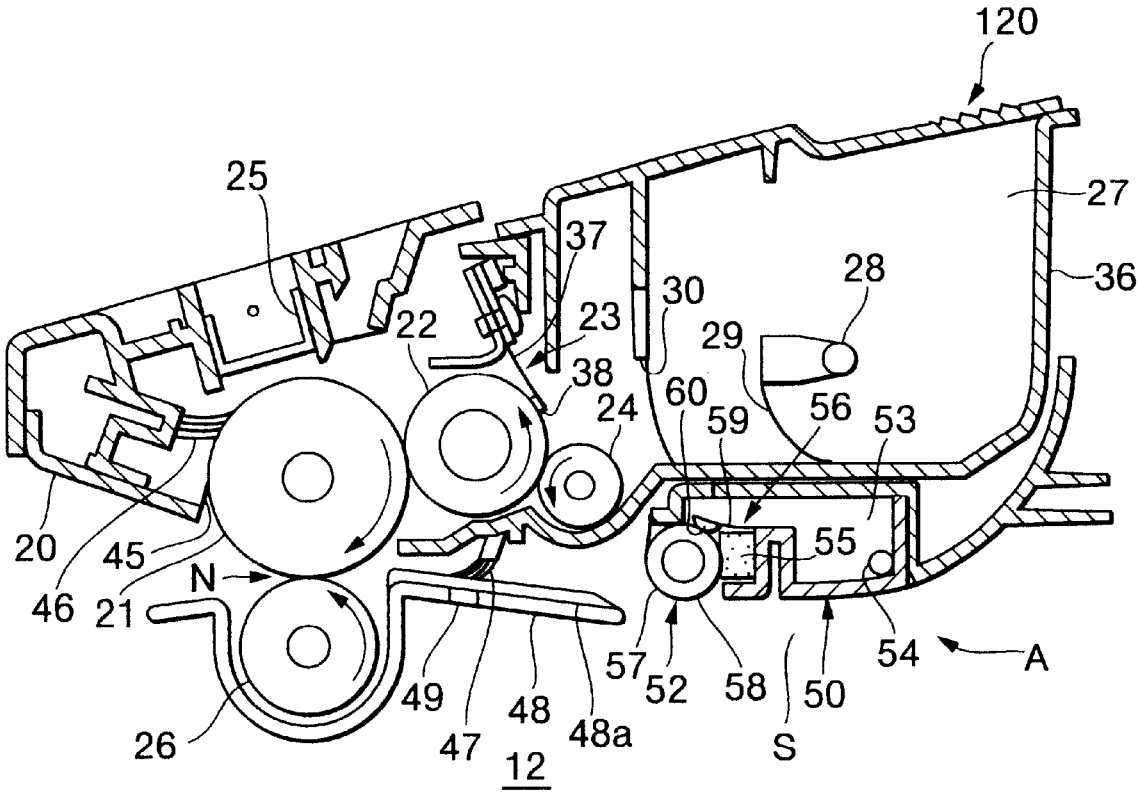
FIG. 12 is a cross-sectional view of a process cartridge, according to a modification of the second embodiment, mounted in the laser printer of FIG. 8.

As shown in FIG. 12, an additional brush 47 may be provided on the outer bottom surface of the process cartridge 120. The additional brush 47 is located at a position downstream from the second paper dust removing unit 50 but upstream from the transfer position N in the sheet conveying direction A along the sheet transport path S. In this case, a tip end of the additional brush 47 contacts a guide plate 48. It is noted that the guide plate 48 is fixedly secured to the printer casing 2 so as to guide a sheet of paper P, which is being fed by the pinch roller 52 and the feed roller 51, to the transfer position N. A plurality of ribs 48*a* are formed on the guide plate 48. The ribs 48*a* are for smoothly guiding the sheet of paper P on the guide plate 48. When the sheet of paper P is fed by the pinch roller 52 and the feed roller 51, the sheet of paper P is transported as being guided by the ribs 48*a* on the guide plate 48 to the transfer position N. At this time, the additional brush 47 removes pulp fibers from the sheet of paper P. Through-holes 49 are formed through the guide plate 48 at positions between the ribs 48*a*. The pulp fibers, removed from the sheet of paper P, fall through the through-holes 49. In this case, the sheet of paper P can reach the transfer position N after both of the fiber and filler components of the paper dust are removed from the sheet of paper P. Even when a slight amount of remaining paper dust is transferred to the photosensitive drum 21 at the transfer position N, the first paper dust removing brush 46 can properly remove the paper dust from the photosensitive drum 21. It is ensured that paper dust rill not enter the development cartridge 36.

When the process cartridge 120 is removed from the printer casing 2, it is possible to replace the second paper dust removing unit 50, the first paper dust removing brush 46, and the additional brush 47 with new ones. This facilitates the maintenance of the printer 2.

It is noted that the second paper dust removing member 50 can remove both of fiber material and filler material from the sheet of paper P. Contrarily, the additional brush 47 can hardly remove filler material from the sheet of paper P. Thus, the ability of the second paper dust removing member 50 removing the filler material is greater than the ability of the additional brush 47 removing the filler material.

Figure 13:
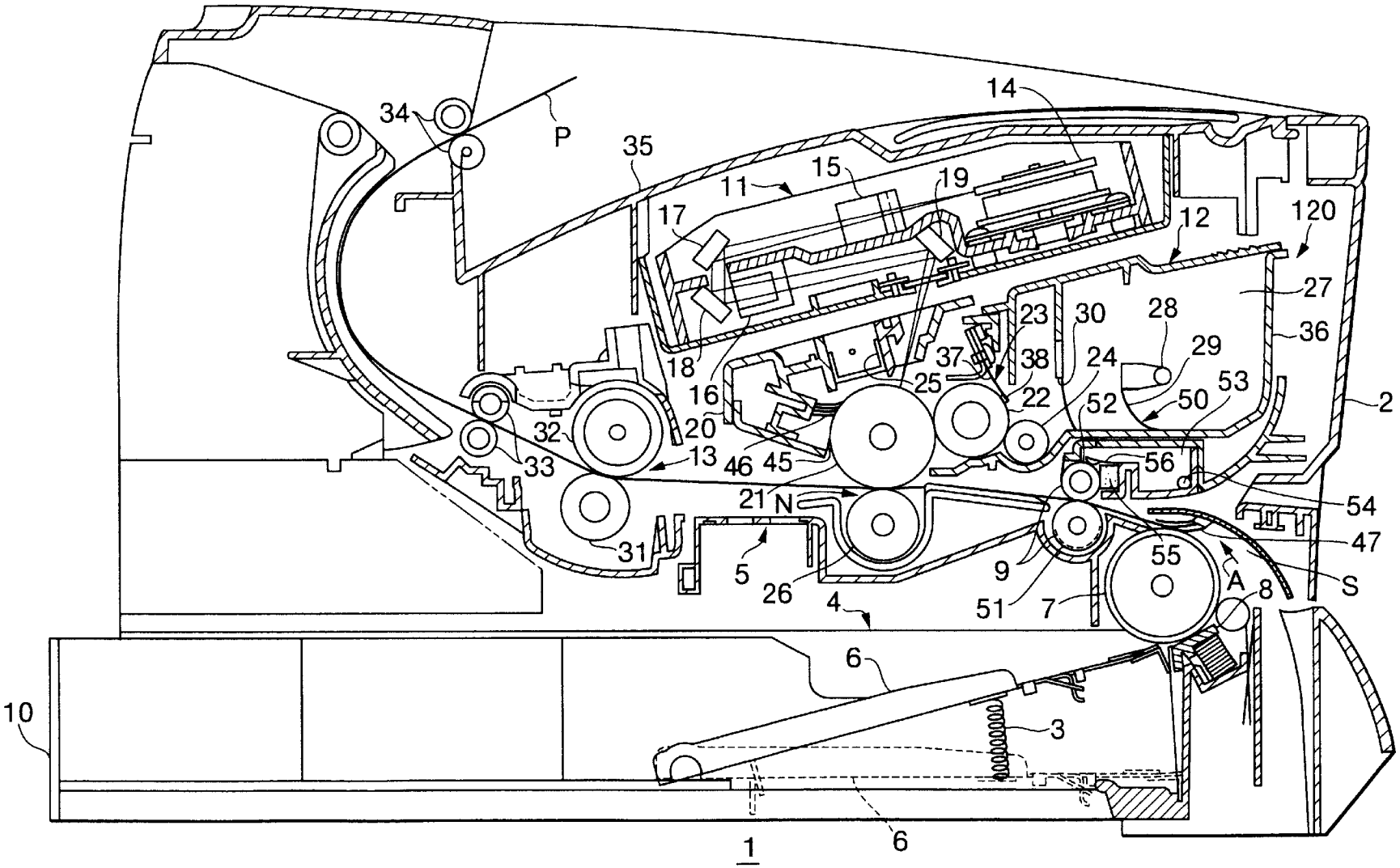
FIG. 13 is a cross-sectional view showing essential parts of a laser printer according to another modification of the second embodiment of the present invention.

In the above-described modification, the additional brush 47 is located between the second paper dust removing unit 50 and the transfer position N in the sheet conveying direction A along the sheet transport path S. However, the additional brush 47 may be located upstream from the second paper dust removing unit 50 in the sheet conveying direction A along the sheet transport path S. For example, as shown in FIG. 13, the additional brush 47 may be provided over the feed roller 7. In this case, the additional brush 47 can remove pulp fibers from the sheet of paper P immediately after the sheet of paper P is taken out from the sheet cassette 10.

In both of the modifications of FIGS. 12 and 13, the additional brush 47 has a width, in a direction orthogonal to the sheet conveying direction A, which is longer than the width of the maximum sized paper that can be supplied from the sheet cassette 10.

In the above description, the second paper dust removing unit 50 is provided pivotally relative to the process cartridge 120. However, the second paper dust removing unit 50 may be provided pivotally relative to the printer casing 2.

In the above description, the second paper dust removing unit 50 is positioned so that its constituent roller 52 serves as a part of the register roller unit 9. However, the position of the second paper dust removing unit 50 is not limited to that described above. For example, the second paper dust removing unit 50 may be positioned over the feed roller 7 in a manner that the second paper dust removing unit 50 can pivot relative to the printer casing 2. In this case, the register roller unit 9 is constructed similarly as in the first embodiment. The second paper dust removing unit 50 is provided separately from the register roller unit 9. The second paper dust removing unit 50 may be provided at any other positions that are upstream from the transfer position N in the sheet conveying direction A along the sheet transport path S.

It is noted that even a woven fabric or knitted fabric can be used instead of the non-woven fabric 60 because fibers entangled into the integral mass of the woven fabric or the knitted fabric can also catch the fine paper dust sufficiently. Similarly, resilient foam material can be used instead of the non-woven fabric 60. The resilient foam material 60 may be fixed to one end of the polyethylene terephthalate film 59 of the scraper 56. A sponge 60 can be fixed to one end of the polyethylene terephthalate film 59.

As described above, according to the first embodiment, the first paper-dust removing device 610 is provided to mainly remove pulp fibers of the paper dust. The first paper-dust removing device 710 is located downstream from the transfer position N in the photosensitive drum rotating direction B. The second paper-dust removing device 710 is provided to mainly remove talc in the paper dust. The second paper-dust removing device 710 is located downstream from the first paper dust removing device 610 in the photosensitive drum rotating direction B. According to the second embodiment, the first paper-dust removing device 46 is provided to mainly remove pulp fibers of the paper dust. The first paper-dust removing device 46 is located downstream from the transfer position N in the photosensitive drum rotating direction B. The second paper-dust removing device 50 is provided to mainly remove talc in the paper dust. The second paper-dust removing device 50 is located upstream from the transfer position N in the sheet conveying direction A along the sheet transport path S. The additional first paper-dust removing device 47 may be located upstream from the transfer position N in the sheet conveying direction A along the sheet transport path S.

Thus, according to the first and second embodiments, the fiber material is reliably removed by the first paper-dust removing device 610, 46, 47, and the filler material is reliably removed by the second paper-dust removing device 710, 50.

While the invention has been described in detail with reference to the specific embodiment thereof, it would be apparent to those skilled in the art that various changes and modifications may be made therein without departing from the spirit of the invention, the scope of which is defined by the attached claims.

For example, in the above-described embodiments, a positive polarity toner is used. However, a negative polarity toner can be used instead. Also, a crushed type toner can be used instead of the polymerized toner. When the negative polarity toner is used, then a charge control resin including an anion function group can be mixed in with toner material.

In the second embodiment, the photosensitive drum 21, the charge unit 25, and the paper-dust removing devices 46 (47) and 50 are mounted in the process cartridge 120. The process cartridge 120 is detachably mounted to the casing 2 of the laser printer 1. Contrarily, in the first embodiment, the photosensitive drum 21, the charge unit 25, and the paper-dust removing device 610 are mounted directly to the casing 2 of the laser printer 1. However, according to the first embodiment, similarly to the second embodiment, the process cartridge 120 may be employed to mount therein the photosensitive drum 21, the charge unit 25, and the paper-dust removing devices 610 and 710. It is noted that the process cartridge 120 is constructed from a combination of the drum cartridge 20 and the development cartridge 36. For example, the paper-dust removing device 610 may be mounted in the drum cartridge 20. The paper-dust removing device 710 may be mounted to either the drum cartridge 20 or the development cartridge 36 according to the structure of the paper-dust removing device 710.

According to the second embodiment, similarly to the first embodiment, the photosensitive drum 21, the charge unit 25, the paper-dust removing devices 46, 47, and 50 may be mounted directly in the casing 2.

In the second embodiment and its modifications, the first paper dust removing brush 46 is provided for removing fiber component of the paper dust from the photosensitive body 21, and the second paper dust removing unit 50 is provided for removing filler component of the paper dust from the sheet of paper P that is being conveyed along the sheet transport path S. However, the first paper dust removing brush 46 may be provided for removing fiber component of the paper dust from the sheet of paper P that is being conveyed along the sheet transport path S, and the second paper dust removing unit 50 may be provided for removing filler component of the paper dust from the photosensitive body 21. In this case, the first paper dust removing brush 46 is positioned upstream from the transfer position N in the sheet conveying direction A along the sheet transport path S. The second paper dust removing unit 50 is positioned in contact with the surface of the photosensitive drum 21 at a location downstream from the transfer position N in the rotating direction B of the photosensitive drum 21.

In the modifications of the second embodiment, the additional first paper dust removing brush 47 is provided on the sheet conveying path S. The additional first paper dust removing brush 47 can remove fiber component of the paper dust from the sheet of paper P before the sheet reaches the transfer position N. Accordingly, the first paper dust removing brush 46 can be omitted. A plurality of additional first paper dust removing brushes 47 can be provided at positions upstream from the transfer position N in the sheet conveying direction A along the sheet transport path S.

What is claimed is:

1. An image forming apparatus, comprising:

a paper conveying unit conveying a sheet of paper along a predetermined paper transport path in a paper conveying direction toward a predetermined transfer position;

an image transfer unit located on the transfer position, the image transfer unit transferring a visible image, which is formed by development agent, onto the sheet of paper transferred to the transfer position;

a first paper dust removing member that is positioned at a first predetermined position upstream from the transfer position in the paper conveying direction along the paper transport path, the first paper dust removing member removing a first component in paper dust from the sheet of paper; and a second paper dust removing member that is positioned at a second predetermined position upstream from the transfer position in the paper conveying direction along the paper transport path, the second paper dust removing member removing a second component in paper dust from the sheet of paper.

2. An image forming apparatus as claimed in claim 1, wherein the second paper dust removing member removes also the first component from the sheet of paper, the second paper dust removing member having a greater ability of removing the second component than the first paper dust removing member.

3. An image forming apparatus as claimed in claim 1, wherein the image transfer unit includes an image bearing body having an image bearing surface, the image bearing surface bearing thereon the visible image that is formed through development of an electrostatic latent image by the developing agent, the image bearing surface moving along a predetermined image moving path in a predetermined image moving direction, thereby carrying the visible image, the predetermined image moving path and the predetermined paper transport path being arranged so that the sheet of paper is brought into contact with the image bearing surface when the sheet of paper reaches the predetermined transfer position, the visible image being transferred from the image bearing surface to the sheet of paper when the sheet of paper reaches the predetermined transfer position, further comprising a developing unit developing, with the developing agent, the electrostatic latent image into the visible image, the developing unit being located at a position downstream from the transfer position along the image moving path in the image moving direction.

4. An image forming apparatus as claimed in claim 3, wherein the image transfer unit further includes a transfer member that is positioned in the predetermined transfer position, the transfer member allowing the image bearing body to transfer the visible image from the image bearing body onto the sheet of paper.

5. An image forming apparatus as claimed in claim 3, wherein the image bearing body includes a photosensitive body.

6. An image forming apparatus as claimed in claim 1, wherein the first component includes fiber material of the paper dust, and the second component includes filler material of the paper dust.

7. An image forming apparatus as claimed in claim 1, wherein the first paper dust removing member includes a brush that contacts the surface of the sheet of paper which is being conveyed at the first predetermined position, and the second paper dust removing member includes a roller that contacts the surface of the sheet of paper which is being conveyed at the second predetermined position.

8. An image forming apparatus as claimed in claim 1, wherein the first paper dust removing member includes a brush that contacts the surface of the sheet of paper which is being conveyed at the first predetermined position, and the second paper dust removing member includes a non-woven fabric that removes the second component from the sheet of paper which is being conveyed at the second predetermined position.

9. An image forming apparatus as claimed in claim 8, wherein the second paper dust removing member further includes a roller that contacts the surface of the sheet of paper, which is being conveyed at the second predetermined position, thereby removing the second component from the sheet of paper, the non-woven fabric being provided in contact with the roller, thereby removing the second component from the roller.

10. An image forming apparatus as claimed in claim 1, wherein each of the first and second paper dust removing members includes a contact portion contacting the surface of the sheet of paper to remove the corresponding component of the paper dust therefrom, the contact portion having a width along a direction orthogonal to the paper conveying direction, the width being greater than a width of the sheet of paper along the direction orthogonal to the paper conveying direction.

11. An image forming apparatus as claimed in claim 10, wherein the paper conveying unit includes:

a paper holder which holds therein a sheet of paper whose width is smaller than or equal to a predetermined maximum width; and a paper supplying portion supplying a sheet of paper one at a time from the paper holder to the sheet transport path, and wherein the width of the contact portion of each of the first and second paper dust removing members is greater than the predetermined maximum width.

12. An image forming apparatus, comprising:

a paper conveying unit conveying a sheet of paper along a predetermined paper transport path in a paper conveying direction toward a predetermined transfer position;

an image transfer unit located on the transfer position, the image transfer unit transferring a visible image, which is formed by development agent, onto the sheet of paper transferred to the transfer position;

a first paper dust removing member that is positioned at a first predetermined position upstream from the transfer position in the paper conveying direction along the paper transport path, the first paper dust removing member removing a first component in paper dust from the sheet of paper; and a second paper dust removing member that is positioned at a second predetermined position upstream from the transfer position in the paper conveying direction along the paper transport path, the second paper dust removing member removing the first component and a second component in paper dust from the sheet of paper, the second paper dust removing member having a greater ability of removing the second component than the first paper dust removing member.

* * * * *